US009694275B2

(12) United States Patent
Hawkins et al.

(10) Patent No.: US 9,694,275 B2
(45) Date of Patent: Jul. 4, 2017

(54) ELECTRONIC DICE

(71) Applicant: SCOSCHE INDUSTRIES, INC., Oxnard, CA (US)

(72) Inventors: Scott Allan Hawkins, Foothill Ranch, CA (US); Scott Anthony Pennestri, Liberty Lake, WA (US); Richard Donald Maes, Liberty Lake, CA (US)

(73) Assignee: SCOSCHE INDUSTRIES, INC., Oxnard, CA (US)

( * ) Notice: Subject to any disclaimer, the term of this patent is extended or adjusted under 35 U.S.C. 154(b) by 0 days.

(21) Appl. No.: 14/139,340

(22) Filed: Dec. 23, 2013

(65) Prior Publication Data

US 2014/0309016 A1 Oct. 16, 2014

Related U.S. Application Data

(63) Continuation of application No. 13/615,367, filed on Sep. 13, 2012, now Pat. No. 8,662,995, which is a continuation of application No. 12/371,474, filed on Feb. 13, 2009, now abandoned.

(60) Provisional application No. 61/029,270, filed on Feb. 15, 2008.

(51) Int. Cl.
*A63F 9/04* (2006.01)

(52) U.S. Cl.
CPC ..... *A63F 9/0468* (2013.01); *A63F 9/04* (2013.01); *A63F 2009/0422* (2013.01); *A63F 2009/0424* (2013.01); *A63F 2009/0426* (2013.01); *A63F 2009/0428* (2013.01); *A63F 2009/0431* (2013.01); *A63F 2009/0433* (2013.01); *A63F 2009/0435* (2013.01); *A63F 2009/0437* (2013.01); *A63F 2009/0491* (2013.01)

(58) Field of Classification Search
CPC ..... A63F 9/0468; A63F 9/04
USPC ..... 463/22
See application file for complete search history.

(56) References Cited

U.S. PATENT DOCUMENTS

| | | | |
|---|---|---|---|
| 2,572,454 | A | 10/1951 | Down et al. |
| 3,518,786 | A | 7/1970 | Holtvoight |
| 3,596,391 | A | 8/1971 | Knight, Jr. |
| 3,703,045 | A | 11/1972 | Nyman |
| 3,774,332 | A | 11/1973 | Schneider |
| 3,811,683 | A | 5/1974 | Street |

(Continued)

FOREIGN PATENT DOCUMENTS

| | | | |
|---|---|---|---|
| JP | 2005230306 | | 9/2005 |
| JP | 2005230306 | A * | 9/2005 |

(Continued)

OTHER PUBLICATIONS

"3DM" sourced from www.microstrain.com/3dm.aspx. Accessed Dec. 24, 2005.*

(Continued)

*Primary Examiner* — Steven J Hylinski
(74) *Attorney, Agent, or Firm* — Arent Fox LLP

(57) ABSTRACT

An electronic die capable of reporting roll results is disclosed. The die can include an acceleration measurement system capable of outputting roll data. A processor can then interpret the roll data and transmit it through a wireless interface to a monitoring device. The monitoring device can then show a user the roll result. Waking the electronic die from a low power mode is also disclosed along with customizing the electronic die with faceplates and protective covers.

35 Claims, 23 Drawing Sheets

(56) References Cited

U.S. PATENT DOCUMENTS 4,148,488 A 4/1979 Kohlhagen
4,542,647 A * 9/1985 Molnar ..... E21B 47/022 175/45
4,682,778 A 7/1987 Willis et al.
4,858,931 A 8/1989 McKechnie
4,891,642 A 1/1990 Muller
5,251,908 A 10/1993 Myers
5,295,387 A * 3/1994 Buie ..... G01P 21/00 73/1.38
5,448,146 A 9/1995 Erlbacher
5,602,496 A * 2/1997 Mahmood ..... 326/71
5,606,124 A * 2/1997 Doyle ..... E21B 47/022 33/304
5,694,045 A 12/1997 Ikeda et al.
5,915,417 A * 6/1999 Diaz et al. ..... 137/624.11
6,122,960 A * 9/2000 Hutchings ..... A63B 24/00 73/493
6,220,594 B1 4/2001 Peng
6,256,914 B1 7/2001 Yeh
6,331,145 B1 12/2001 Sity et al.
6,454,482 B1 * 9/2002 Silverbrook et al. ..... 401/195
6,469,639 B2 * 10/2002 Tanenhaus et al. ..... 340/870.16
6,533,275 B2 3/2003 Zaruba et al.
6,588,756 B1 7/2003 Hughes
6,590,536 B1 7/2003 Walton
6,609,710 B1 8/2003 Order
6,701,788 B2 * 3/2004 Babala ..... 73/649
6,883,638 B1 4/2005 Maxwell et al.
6,923,441 B2 8/2005 Inoue
6,923,442 B2 8/2005 Dewa et al.
6,997,458 B1 2/2006 Yokomi
7,000,469 B2 2/2006 Foxlin et al.
7,017,905 B2 3/2006 Lindsey
7,084,762 B2 * 8/2006 Pedrazzini et al. ..... 340/545.5
7,318,349 B2 * 1/2008 Vaganov et al. ..... 73/514.33
7,364,487 B2 4/2008 Evans et al.
7,457,719 B1 * 11/2008 Kahn ..... A61B 5/1118 702/141
D587,465 S 3/2009 Wang et al.
D616,045 S 5/2010 Tervo
7,774,155 B2 * 8/2010 Sato ..... A63F 13/06 345/156
7,877,224 B2 * 1/2011 Ohta ..... A63F 13/10 702/152
7,942,745 B2 * 5/2011 Ikeda ..... A63F 13/06 340/12.22
8,583,392 B2 * 11/2013 Panagas ..... 702/104
8,662,995 B2 * 3/2014 Hawkins et al. ..... 463/22
2002/0103610 A1 * 8/2002 Bachmann ..... A61B 5/1114 702/94
2004/0036213 A1 * 2/2004 Lindsey ..... 273/146
2005/0076161 A1 * 4/2005 Albanna ..... A63F 13/10 710/15
2005/0101314 A1 * 5/2005 Levi ..... H04L 63/0861 455/423
2005/0143173 A1 6/2005 Barney et al.
2005/0160814 A1 * 7/2005 Vaganov ..... G01P 15/18 73/514.01
2005/0164778 A1 7/2005 Cooney
2005/0215312 A1 * 9/2005 Tresser et al. ..... 463/22
2005/0242947 A1 * 11/2005 Burneske ..... G01C 21/005 340/539.13
2006/0087075 A1 4/2006 Marksberry
2006/0204232 A1 * 9/2006 Weinberg ..... G03B 7/00 396/50
2006/0272413 A1 * 12/2006 Vaganov ..... G01P 15/18 73/514.01
2006/0277571 A1 * 12/2006 Marks ..... A63F 13/00 725/37
2007/0018890 A1 * 1/2007 Kulyukin ..... G01C 21/005 342/357.31
2007/0214886 A1 * 9/2007 Sheynblat ..... G01P 15/18 73/509
2008/0122612 A1 * 5/2008 LaRue ..... 340/539.1
2008/0174550 A1 * 7/2008 Laurila ..... A63F 13/02 345/158
2008/0211182 A1 9/2008 Hochstrasser
2008/0248849 A1 10/2008 Lutnick et al.
2008/0254881 A1 10/2008 Lutnick et al.
2009/0104976 A1 * 4/2009 Ouwerkerk et al. ..... 463/22
2009/0227315 A1 * 9/2009 LaRue ..... A63F 13/005 463/16
2010/0291993 A1 * 11/2010 Gagner ..... A61B 5/1118 463/25

FOREIGN PATENT DOCUMENTS

JP 2007275107 A * 10/2007
WO 9425130 11/1994
WO 9513849 5/1995
WO WO 2006046169 A1 * 5/2006 ..... A63F 9/04

OTHER PUBLICATIONS

"3DM Solid State 3-Axis Pitch, Roll and Yaw Sensor", Dec. 24, 2005, www.microstrain.com/3dm.aspx.
"Inertia-Link Spatial Measurement Unit and Vertical Gyro", Oct. 14, 2006, www.microstrain.com/inertia-link.aspx.
"3DM-GX1", accessed Nov. 25, 2005, source: http://www.microstrain.com/3dm-gx1.aspx.
Loaded Dice, "NiceScientist", Nov. 18, 2000, www.newscientist.com/article/mg16822651.300, 4 pages downloaded and printed from the World Wide Web on or about Jan. 22, 2009.
Game Inventors and Designers, "Zap Games", www.cricro.com/dice/concept.html, 2 pages downloaded and printed from the World Wide Web on or about Feb. 6, 2009.

* cited by examiner

ELECTRONIC DICE

RELATED APPLICATIONS

The present application claims priority benefit from U.S. patent application Ser. No. 13/615,367, filed Sep. 13, 2012, which claims priority from U.S. patent application Ser. No. 12/371,474, which claims priority from U.S. Provisional Application No. 61/029,270, filed Feb. 15, 2008. The present application incorporates the entirety of the foregoing disclosures herein by reference.

FIELD OF THE DISCLOSURE

The present application relates to a numerical, graphical, or alphanumeric gaming die, and more specifically to an electronic gaming die.

A die is polyhedral object used for generating random numbers or other symbols, used in association with games or gambling. A die or a plurality of dice is thrown or rolled so that the sides of the polyhedron move about until the die or dice comes to rest. At rest, the polyhedral then indicates the generated number, numbers, symbol, or symbols. Games traditionally employing the use of dice include board games, tabletop games such as backgammon, and gambling games such as craps and sic bo.

The use of dice in games can be enhanced by relating the generated number, numbers, symbol, or symbols, to one or more aspects of game play. Traditionally game sellers have packaged dice with differentiating features such as colors, number of sides, markings, or other features. For example, a board game might include red dice for use in one aspect of game play and white dice for another aspect. Another example might be a game including dice with numbers indicated on the faces for use in one aspect of play and dice with a number of symbols or colors for another aspect of game play.

The surface on which dice are rolled and surrounding area can impact the roll results. Dice can also damage objects on or proximate to the surfaces on which they are rolled. The surfaces on which dice or rolled or objects proximate to the roll location can also damage dice.

SUMMARY OF THE DISCLOSURE

Based on some of all of the foregoing, there is an industry need for a numerical, graphical, or alphanumeric gaming die, and more specifically an electronic gaming die. Moreover, there is also an industry need for dice with differentiating features and to protect the original shape and finish game pieces and surrounding areas against damage generally associated with normal use. Aspects of the present disclosure include an electronic die that detects and reports roll results to a monitoring device. In an embodiment, the electronic die allows a user to experience the tactile sensation of throwing or rolling dice while providing a wireless interface over which the roll results are transmitted. In some embodiments, electronics for detecting and reporting roll results can be self-contained, minimizing the need for additional equipment.

Aspects of the present disclosure further include the selection of appropriate materials, shape, and markings of a die case suitable for mimicking the shape and feel of standard die while enclosing suitable electronics. In some embodiments, the wireless interface, in particular, makes the selection of casing materials difficult.

Aspects of the present disclosure also include weight balancing the electronic die. The weight balancing helps increase a likelihood that each face is approximately equally likely to appear as a roll result.

The power source for an electronic die is also an aspect of the present disclosure. In an embodiment, the power source is a battery. In an embodiment, the power source is a rechargeable battery that is charged in a charging station.

Aspects of the present disclosure also include an acceleration measurement system for an electronic die. In an embodiment, the acceleration measurement system includes a three-axis accelerometer.

A sleep control system for an electronic die is also disclosed. In an embodiment, the sleep control system places the electronic die in a low power mode after a period of inactivity. In an embodiment, a user shakes the electronic die to wake the device from a low power mode.

A processor and wireless interface for an electronic die is also disclosed. The wireless interface allows the electronic die to report roll results to a monitoring system. In an embodiment, the electronic die reports real-time roll results as the die continues to move. In an embodiment, the electronic die reports real-time roll data as the die continues to move. The term "real time" includes its ordinary broad meaning to one of ordinary skill in the art, which includes both hard and soft real time, and can provide data at a rate sufficient to display a roll in progress.

A monitoring device for communicating with the electronic die is also disclosed. In an embodiment, the monitoring device receives and displays roll results from an electronic die. In an embodiment, the monitoring device transmits data to the device.

The use of electronics to keep track of dice roll results can provide substantial advantages in casino and other traditional gaming. Video games and personal computer games, for example, could incorporate roll results to enhance game play. The popularity of game systems such as the Nintendo® Wii™ have provided examples of the strong desire for interactive play with game controllers that to at least some degree measure or record physical gestures. Board games, plug and play television devices, and DVD games can also incorporate roll results to enhance game play. In another setting, casinos can expand the number of players at a craps table, for example, by allowing online, real-time bet placement with semi-automated dealers based on identifying the outcome of rolled dice.

Aspects of the present disclosure include a game piece cover and faceplates for customizing electronic game pieces. In an embodiment, a customizable game piece includes one or more faceplates and a protective cover. In an embodiment, the protective cover is a flexible jacket.

Aspects of the present disclosure further include the selection of appropriate materials, shape, and markings of faceplates and protective covers. Roll performance for dice on different surfaces and wireless signal transparency, in particular, can make the selection of materials difficult.

Based on at least the foregoing, a need exists for a straightforward, easily portable, protective device for reducing potentially damaging dings and chips consistent with both short and long term normal use for electronic game pieces. In an embodiment, a protective cover is placed over some or all of the edges of a game piece. For example, in the instance of a die, a cover may comprise a pliable rubber jacket that friction fits over one or more extremities. In an embodiment, the pliable jacket may be pre-fanned to substantially match a particular game piece, or may be shaped to generically fit multiple game pieces and/or brands of game pieces. In an embodiment, the protective cover comprises a transparent material such that the finish of the game piece is readily viewable through the cover. In other embodiments, the cover may be colored for aesthetic value. In an embodiment, the cover can remain on the game piece without changing, or at least without substantially changing or impacting the game performance piece.

In some embodiments, the protective cover comprises a plastic or other type of enclosure (including without limitation, wood, metal, cardboard, glass, fabric, rubber, rubber-like materials, leather, combinations of some or all of the foregoing or the like) having at least one open side for accepting the shape of a particular game piece. In an embodiment, the cover may include a pivot point capable of opening the enclosure to accept, for example, a multi-edge extremity of a game piece. Once positioned, portions of the plastic enclosure pivot around, for example, a hinge, and snap closed over the game piece. In an embodiment, components of the plastic enclosure may include an attachment mechanism, such as, for example, a detent and catch, or the like (such as a velcro type attachment), for releasably securing the enclosure around portions of the game piece. In still other embodiments, the hard plastic enclosure may comprise a multi-component enclosure that, for example, removably snaps fits together to form an appropriate protective cover. In still other embodiments, the enclosure may be flexible to allow the user to manually stretch it over the game piece, with the device held onto the game piece by the force of the device as it tries to return to its natural state.

In other embodiments, the protective cover may be made to attach to any edge of a game piece that may be at risk of damage from accidental contact. The protective cover could be tape or a material that is cut or terminated to fit a game piece and the selected portion to be protected.

A need also exists for customizing game pieces for use in additional games. In an embodiment, reversible faceplates attached to a die. The faceplates can include different indicators on each side, allowing for user customization and enhanced game play. For example, in the instance of a die, a face plate may comprise a plastic piece that friction fits over one or more sides. In an embodiment, the faceplate may be preformed to substantially match a particular game piece, or may be shaped to generically fit multiple game pieces and/or brands of game pieces. In an embodiment, the faceplate comprises a reversible accessory with number indicators on one side and a different indicator on the other side. In other embodiments, the indicators may user definable. In an embodiment, the faceplate can remain on the game piece without changing, or at least without substantially changing or impacting the game performance piece, such as the roll characteristics of a die.

In some embodiments, the faceplate comprises a plastic, wood, metal, rubber, composite, or other type of material. In an embodiment, the faceplate may be adapted to receive screw or other attachment aid to secure the faceplate to the game piece. In an embodiment, components of a game piece may include an attachment mechanism, such as, for example, a detent and catch, or the like (such as a velcro type attachment), for releasably securing the faceplate to the game piece. In still other embodiments, the hard plastic faceplate may a shape that removably snaps fits together with the game piece. In still other embodiments, the faceplate may be shaped to fit particular aspects of a game piece.

For purposes of summarizing the invention, certain aspects, advantages and novel features of the invention have been described herein. It is to be understood that not necessarily all such aspects, advantages or features will be embodied in any particular embodiment of the invention.

DETAILED DESCRIPTION

In an embodiment, an electronic die includes a die casing and an electromechanical assembly, the electromechanical assembly further includes a power source. The die casing can enclose the electromechanical assembly and power source in the shape of a three or more sided die. The die casing can be any three or more sided shape. In an embodiment, the die casing is cubical with pip markings on each of the six sides. In an embodiment, the electronic die reports the motion, orientation, and outcome of a roll of the die to another device. In an embodiment, a sensor in the electronic die outputs a signal indicative of a sensed g force that allows a determination of which axis is vertical and whether that sensed g force is positive or negative indicates which face is up. In an embodiment, a multi-axis accelerometer in the electronic die outputs one or more signals indicative of which face is up as the die comes to rest. In an embodiment, the die processes the signals and performs a series of calculations to determine which face is up and transmits the result to a monitoring device. In an embodiment, the die sends the data from the accelerometer to a monitoring device that performs a series of calculations to determine which face is up. In an embodiment, the electronic die outputs signals indicative of the orientation of the die as it continues to roll. In an embodiment, a measurement of the die's orientation is made before the die is at rest.

Die Casing

Figure 1A:
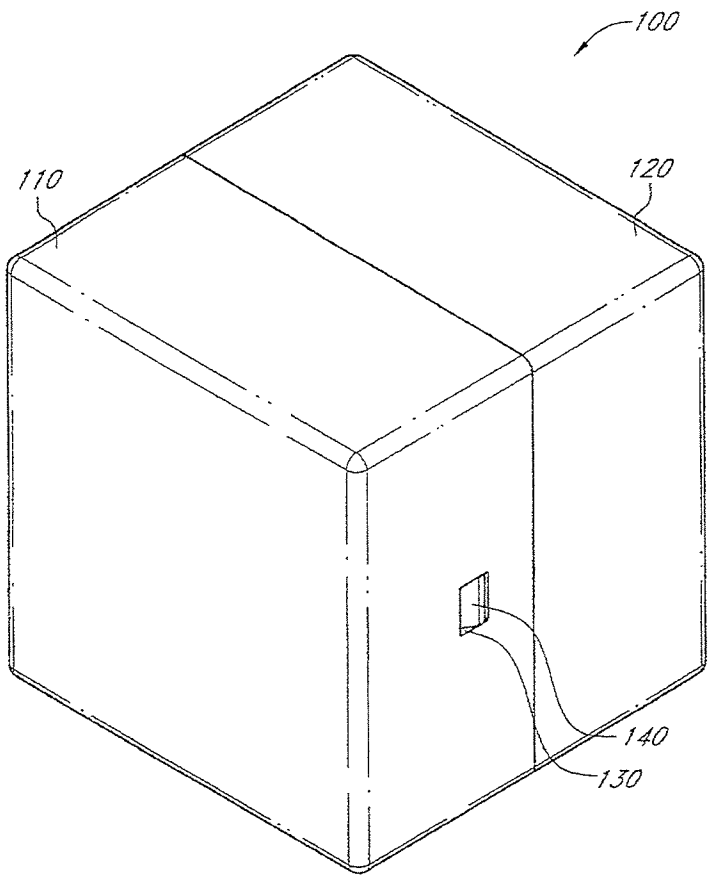
FIG. 1A illustrates a top perspective view of an exemplary embodiment of an assembled die casing for a cubical die.

FIG. 1A represents an embodiment of an assembled cubical electronic die 100. The die 100 includes an A-Half 110 and a B-Half 120. The A-Half 110 and B-Half 120 can be mechanically coupled, such as, for example, with screws, tabs, frictional engagements, snap fits, adhesives, or other suitable mechanical couplings. In an embodiment, the A-Half 110 and B-Half 120 are mechanically coupled with one or more screws. In an embodiment, the A-Half 110 and the B-Half are mechanically coupled with a one or more recesses 130 that interlock with cantilever snap fits 140. The recesses 130 can extend through the side of the die or can remain unseen from the outside face. Die casings for electronic die in other shapes can be mechanically coupled in similar manners.

Figure 1B:
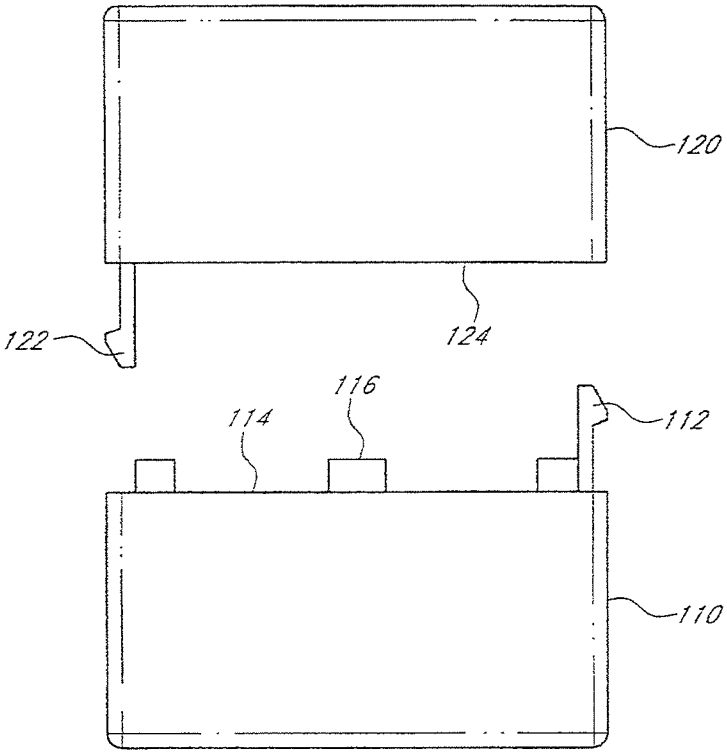
FIG. 1B illustrates a side view of an unassembled die casing for the cubical die embodiment of FIG. 1A.

FIG. 1B represents an embodiment of an unassembled cubical electronic die. A-Half 110 includes a mechanical coupling 112, an enclosure cavity 114, and an electromechanical assembly 116. In an embodiment, the electromechanical assembly includes a power source. The B-Half 120 includes a mechanical coupling 122 and an enclosure cavity 124. The mechanical couplings 112 and 122 illustrated in FIG. 1B are a pair of cantilever snap fits, however, as previously discussed, other suitable mechanical couplings can be used in addition to, or as replacements for, the illustrated mechanical couplings. Combinations of mechanical couplings can also be used to couple the die casing. The enclosure cavity 114 allows for the insertion of electromechanical assembly 116. Electromechanical assembly 116 can include, for example, one or more printed circuit boards with associated components, components connected through cabling, power sources, or other suitable assemblies. Electromechanical assembly 116 is also encapsulated by enclosure cavity 124 on the B-Half of the die. Enclosure cavities 114 and 124 also allow for weight balancing either through the addition or subtraction of material. While the cubical die is shown with two halves in FIG. 1B, in another embodiment, the die casing includes more than two pieces.

Figure 1C:
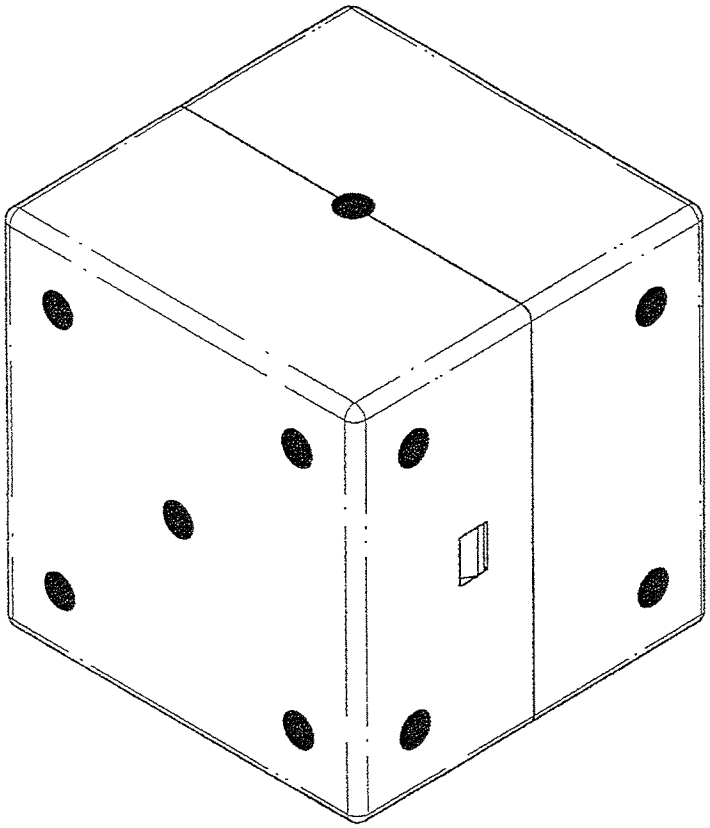
FIG. 1C illustrates a top perspective view of an exemplary cubical die embodiment with pips.
Figure 1D:
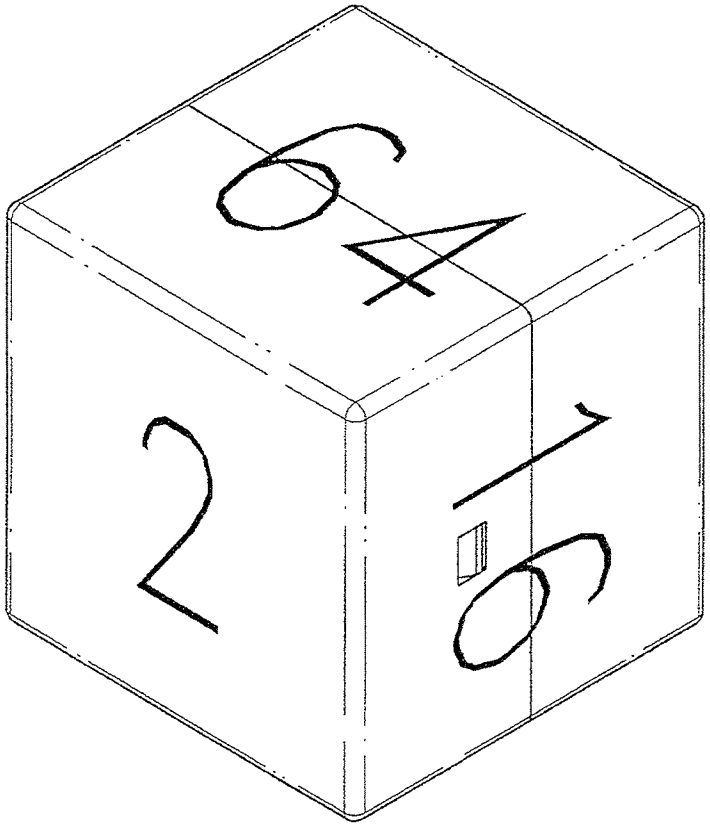
FIG. 1D illustrates a top perspective view of an exemplary cubical die embodiment with numbers.

The die can also have various markings to identify the different die faces or sides. The faces can include markings such as, for example, pips, numbers, symbols, characters, colors, or other suitable markings. In an embodiment, each face color is different. The markings can have different meaning based upon the game played or intended control. The markings can also be different colors. FIG. 1C illustrates an embodiment where the face markings are pips. In an embodiment, the sum of the pips on opposite faces is seven. FIG. 1D illustrates an embodiment where the face markings are numbers. FIG. 1D also illustrates an embodiment where the die is a doubling cube. In an embodiment, the markings are letters.

Although a six-sided die is disclosed, the die casing can have various polyhedron shapes. The die can be any three or more sided shape including shapes, such as, for example, a tetrahedron, an octahedron, dodecahedron, icosahedron, or other suitable shape. In an embodiment, the die is a non-cubical shape. The die can have shapes popularized in role playing games, such as, for example, those used to play Dungeons & Dragons, including, but not limited to, four-, six-, eight-, ten-, twelve-, or twenty-sided shapes.

The die casing can include materials such as, for example, plastic, metal, resin, or other suitable materials. In an embodiment, the die casing material is a high impact plastic. In an embodiment, the die casing material is chosen to maintain adequate radio frequency propagation properties. Material vendors such as, for example, Saint-Gobain Performance Plastics Corporation, manufacture materials with specific, controlled radio frequency performance. In an embodiment, the die is made from a plastic with lossy radio frequency performance to limit transmission distance. Limiting transmission distance can reduce interference between multiple dice and on other devices operating in similar frequency bands. In an embodiment, the die casing is made from metal material. In an embodiment, the die casing serves as an antenna.

Figure 2A:
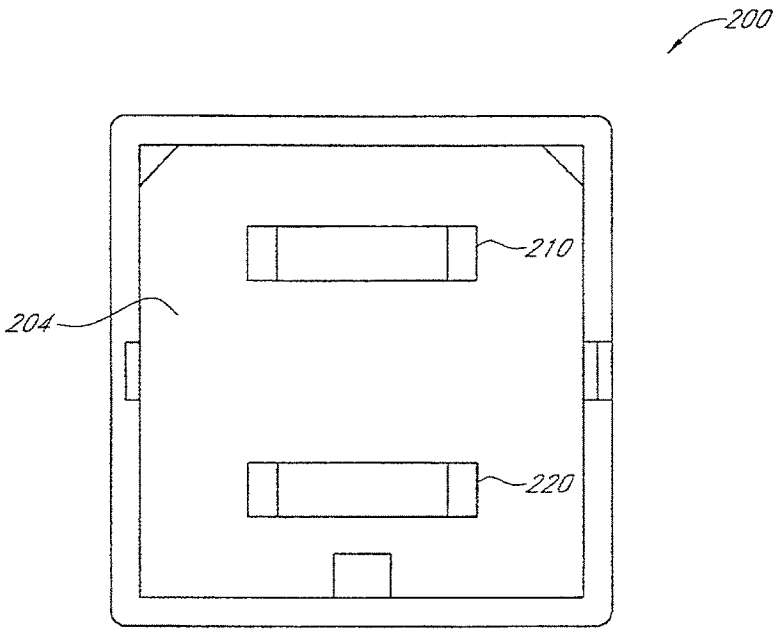
FIG. 2A represents an illustration of a top view of one half of an exemplary cubical die embodiment of FIG. 1A.

FIG. 2A illustrates a top view of one half of an exemplary cubical die embodiment. The half die 200 includes a cavity 204 and an electromechanical assembly 210 with an associated power source 220. The power source can include sources, such as, for example, a one or more batteries, rechargeable batteries, fuel cells, solar cells, or other suitable sources. The power source can also include kinetic energy storage system that stores power from shaking the electronic die. In an embodiment, the power includes a magnet, coil, and capacitor, and shaking the die casing passes the magnet back and forth through the coil creates a current stored in the capacitor. The power source can be replaceable or permanently installed. In an embodiment, the power source is a battery. In an embodiment, the power source is one or more N-sized batteries. In an embodiment, the power source is a rechargeable battery. In an embodiment, the power source is one or more lithium ion batteries. In an embodiment, the power source is a rechargeable battery that is charged through inductive coupling. In an embodiment, the electronic die is inductively coupled to a charging station. In an embodiment, the electronic die is directly electrically connected to a charging station. In an embodiment, the charging station is a dice cup. In an embodiment, the charging station is a dice tray. In an embodiment, the charging station is a playing pad. In an embodiment, the power source is charged by shaking the die. Returning to FIG. 2A, cavity 204 can be formed to ensure that the electromechanical assembly 210 and associated power source 220 remain in position when the die is tossed or shaken. In an embodiment, a structure holds the batteries and electronics is place while the die casing is potted or molded around the system.

Figure 2B:
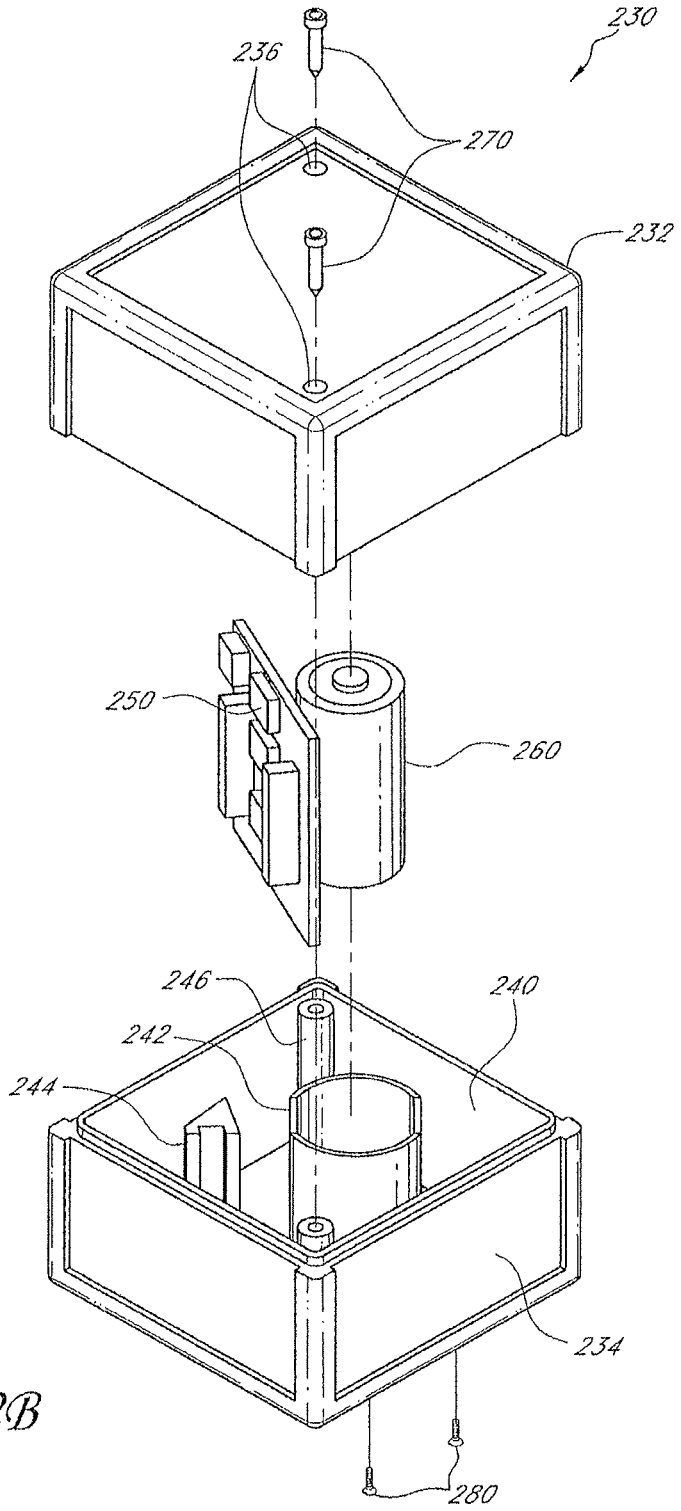
FIG. 2B illustrates an exploded assembly view of an embodiment of an electronic die.

FIG. 2B represents an exploded assembly view of an embodiment of a cubical electronic die 230. Die 230 includes an enclosure formed by an A-Half 232 and a B-Half 234. The enclosure includes a cavity 240, battery support 242, electromechanical assembly support 244, and mechanical coupling 246. The enclosure cavity 240 allows for the insertion of electromechanical assembly 250. Electromechanical assembly 250 can include, for example, one or more printed circuit boards with associated components, components connected through cabling, power sources, or other suitable assemblies. Electromechanical assembly 250 can also be encapsulated by an enclosure cavity on the A-Half 232 of the die. Enclosure cavities also allow for weight balancing either through the addition or subtraction of material. Electromechanical assembly 250 and power source 260 can interface with electromechanical assembly support 244 and battery support 242, respectively. In an embodiment, A-Half 232 includes similar features to those shown in B-Half 234. A-Half 232 can also include holes 236 allowing screws 270 to interface mechanical coupling 246, securing A-Half 232 with B-Half 234. Other configurations of mechanical couplings are also contemplated, such as one screw passing through a hole in the A-Half 232 with another screw passing through the B-Half 234, or the like. In other embodiments, the mechanical coupling is a pair of cantilever snap fits, however, as previously discussed, other suitable mechanical couplings can be used in addition to, or as replacements for, the illustrated mechanical coupling. Combinations of mechanical couplings can also be used to couple the die casing. As shown by the embodiment of FIG. 2B, electromechanical assembly 250 can be mounted at an angle to one or more sides of the A-Half 232 and B-Half 234. The electronic die 230 can also include charging contacts 280. Charging contacts 280 can allow charging of the power source 260 without dissembling electronic die 230. Alternatively, power source 260 can be charged through other methods, as disclosed herein, such as, for example, inductive charging or shaking.

Weight Balancing

Balanced performance is a characteristic of dice. In an embodiment, the probability that any given face is selected on a roll of the dice should be approximately equal. In other embodiments, there is a greater tolerance for weight balancing is permissible. For example, an embodiment for use in casino gaming might have a need for tighter tolerance for weight balancing than a home user embodiment for a video game system. Therefore, there may be a sliding scale for weight balancing performance depending on, for example, price, application, market, material type, weight, size, or other factors. In an embodiment, the electronic die can be weight balanced so that no given face is more likely to be selected during a roll. Returning to FIG. 2B, the cavity 240 can accept additional material or provide for removal of material to weight balance the die. The material added to weight balance the die can be the same material as the die casing or any other suitable material. In an embodiment, die is near balanced during initial manufacturing and the balance is fine-tuned by machining internal surfaces. The position of the electromechanical assembly 250 and power source 260 can also be altered, for example, to weight balance the die based upon the type of power source. In an embodiment, a battery is located just inside the surface of the face. In an embodiment, the electronic die is roughly balanced by milling the faces down to size and finely balanced by drilling the face markings to required depths and at least partially filling the markings with colored material of known mass.

System Block Diagram

Figure 3:
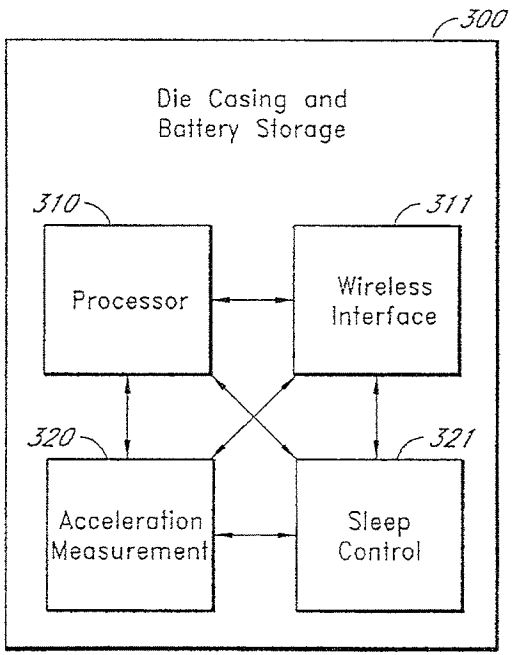
FIG. 3 illustrates an exemplary block diagram of an exemplary embodiment of the cubical die of FIG. 1A.

FIG. 3 illustrates a block diagram of an embodiment of an electronic die. The electronic die includes a die casing and battery storage 300. The die casing 300 encloses the electromechanical assembly including a battery or other power source as previously described. The electromechanical assembly also includes a processor 310, wireless interface 311, an acceleration measurement system 320 and sleep control module 321. The processor 310, wireless interface 311, acceleration measurement system 320, and sleep control module 321 can be separate devices, an integrated module, or combinations of separate devices and modules. In an embodiment a module includes a processor and wireless interface. In an embodiment, the processor and wireless interface are an integrated component. In an embodiment, the processor and wireless interface include a Digi International Inc. XBee 802. 15.4 module.

The die casing and battery storage 300 can include an acceleration measurement system 320 and sleep control system 321. Each of the processor 310, wireless interface 311, acceleration measurement system 320, and sleep control module 321 can communicate with each other. Communication includes its broad ordinary meaning including digital and analog data, software, firmware, combinations of the some or all of the previous, or the like. In some embodiments, the acceleration measurement system 320 and sleep control module 321 can communicate with the processor 310 and wireless interface module 311 in multiple ways including an acceleration data bus, a power bus, and a sleep interface. An acceleration data bus can include analog or digital outputs from the acceleration measurement system. In an embodiment, an acceleration data bus includes three analog outputs from an accelerometer with voltage levels that vary relative to the acceleration force in each of three axes sensed at the accelerometer. A power bus can include signals necessary to provide power for acceleration measurement system 320 and sleep control module 321. In an embodiment, sleep control module 321 includes inputs that detect the state of an acceleration data bus, and based on that state, produces an output to place the electronic die in a low power mode. In an embodiment, sleep control module 321 sums analog acceleration data bus signals, compares the sum to a reference voltage or reference voltages, and produces an output.

Each of these modules is discussed in detail below following a description of the signal flow for an embodiment of the electronic die that implements the non-die casing and battery storage aspects of FIG. 3.

Signal Flow

Figure 4:
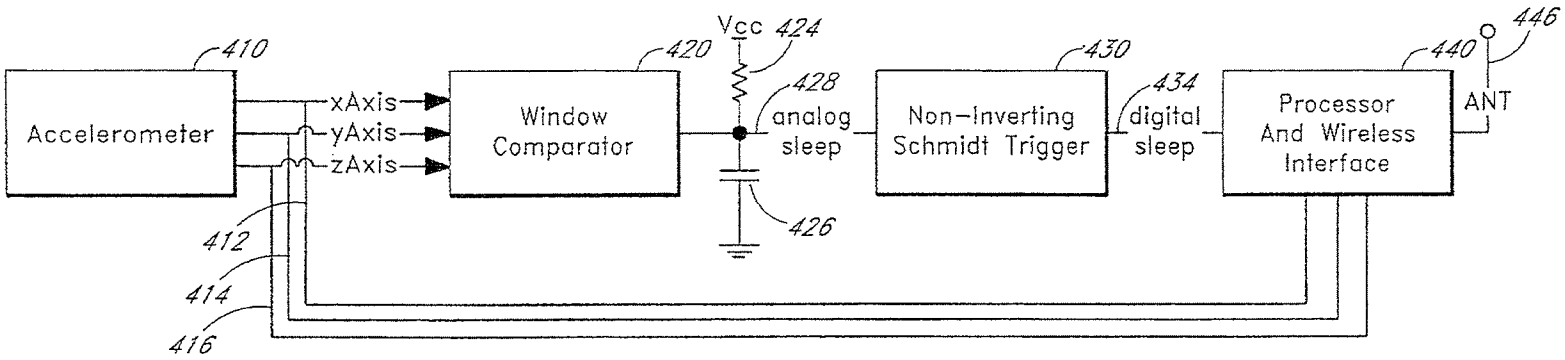
FIG. 4 illustrates a data flow diagram of an exemplary embodiment.

FIG. 4 represents a signal flow for an embodiment of the electronic die. The accelerometer 410 detects and measures acceleration or vibration of the electronic die. In the illustrated embodiment, accelerometer 410 is a three-axis device with three accelerometer outputs: x-axis 412, y-axis 414, and z-axis 416. In an embodiment, accelerometer outputs 412, 414, and 416 are analog signals with voltage that varies proportionally to the detected acceleration. The accelerometer outputs 412, 414, and 416 are electronically connected to both to the sleep control circuitry, beginning with window comparator 420, and to the processor and wireless interface 440.

The sleep control circuitry begins with window comparator 420. Window comparator 420 examines outputs 412, 414, and 416 to determine if accelerometer 410 is outputting a signal, reflecting whether the die is accelerating or vibrating. Additional detail regarding the window comparator 420 can be found with the text associated with FIG. 6. The roll stabilization delay components, resistor 424 and capacitor 426, interact with the output of the window comparator 420 to create an analog sleep signal 428. Resistor 424 and capacitor 426 set a roll stabilization delay, specifying how long the die should be at rest before a roll is considered complete. Capacitor 426 gives analog sleep signal 428 a time-rise curve when the electronic die returns to rest. Analog sleep signal 428 is also connected to the input of Schmitt trigger 430. Schmitt trigger 430 provides noise immunity through the well-known dual threshold property known as hysteresis. The output of Schmitt trigger 430, digital sleep signal 434, is collected to the processor and wireless interface 440.

The processor and wireless interface 440 has inputs including accelerometer outputs 412, 414, and 416 and the digital sleep signal 434, and an output, antenna 446. The processor and wireless interface, convert, and process the accelerometer outputs 412, 414, and 416, transmit digital signals representing the accelerometer state using the antenna 446, and enter a low-power mode once the digital sleep signal 434 is received.

Acceleration Measurement

The acceleration measurement system detects and measures acceleration or vibration of the electronic die. The acceleration measurement system can include readily available measurement devices such as, for example, an analog accelerometer, a digital accelerometer, a piezoelectric sensor, a MEMS accelerometer, a piezoresistive accelerometer, a strain gage based accelerometer, a shear type accelerometer, or other suitable measurement device. In an embodiment, the acceleration measurement system includes an accelerometer. In an embodiment, the acceleration measurement system includes a three-axis accelerometer. In an embodiment, the acceleration measurement system includes an Analog Devices ADXL330, low power MEMS 3-axis accelerometer. In an embodiment, the accelerometer is positioned planar to the surface of the die. Alternatively, the acceleration measurement system can include measurement devices and techniques, such as, for example, tilt switches, reed switches, or floating elements that use gravity to complete a circuit.

Supply Voltage Dropout Compensation

The acceleration measurement system provides outputs indicating the detected acceleration force. In an embodiment, a three-axis accelerometer with analog outputs provides three voltage outputs that vary relative to the detected acceleration force. The analog outputs in such an embodiment can be converted to digital signals using a plurality of analog to digital converters (ADCs). Some ADCs, such as, for example, successive approximation ADCs, provide an internal voltage source for use in the conversion process. The internal voltage source in ADCs is typically designed to provide a very stable voltage. In some situations, particularly when operated from battery power sources, the supply voltage to the devices providing the input to the ADCs can vary more than the ADCs internal voltage source or sources. This varying supply voltage, or dropout, results in either reduced conversion accuracy or improper conversion results. In an embodiment, the ADCs are contained in a single device sharing a common fabrication and a three-axis accelerometer with analog outputs is contained in another device sharing common fabrication, resulting in a proportional supply voltage dropout for each output and ADC.

There can also be mathematical solutions to deal with the supply voltage dropout in an electronic die. The mathematical solutions can vary depending on the number of sides on the die casing. These solutions can be methodically combined with the processing of acceleration measurement to determine the orientation of the die while also compensating for changes in supply voltage. An exemplary method for determining the orientation and compensating for changes in supply voltage is described below for an embodiment of the electronic die with six sides.

Example Method for Power Dropout Compensated Roll Measurement

In an embodiment, the electronic die has six sides and a MEMS three-axis accelerometer mounted planar to a side. The three-axis accelerometer has three outputs, as previously described. The device has also has a single supply voltage, so all three outputs droop relative to one another. Due to the planar mounting of the accelerometer, during a roll as the die approaches rest on a level playing surface, two axes of accelerometer will output readings corresponding to roughly zero gravitational force. The corresponding voltages for those two axes will be very close relative to one another when compared the sensor voltage for the third axis. The voltage reading on the third axis will indicate a reading corresponding to approximately plus or minus one g-force. The method described below can determine the roll result while compensating for power dropout. Similar results can be obtained in other embodiments by, for example, calibrating the acceleration measurement system and normalizing its data.

Figure 5A:
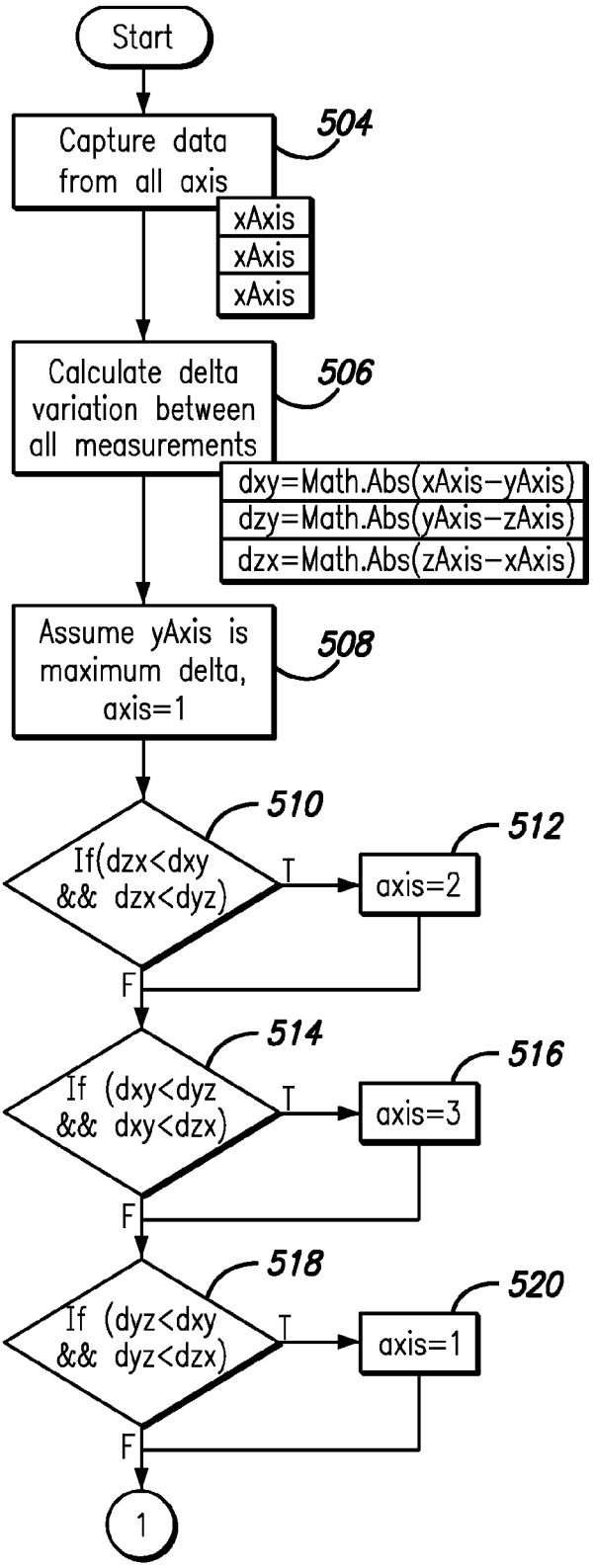
FIGS. 5A and 5B illustrate an exemplary a flow chart of a power dropout compensated method capable of determining the motion and position of a die.
Figure 5B:
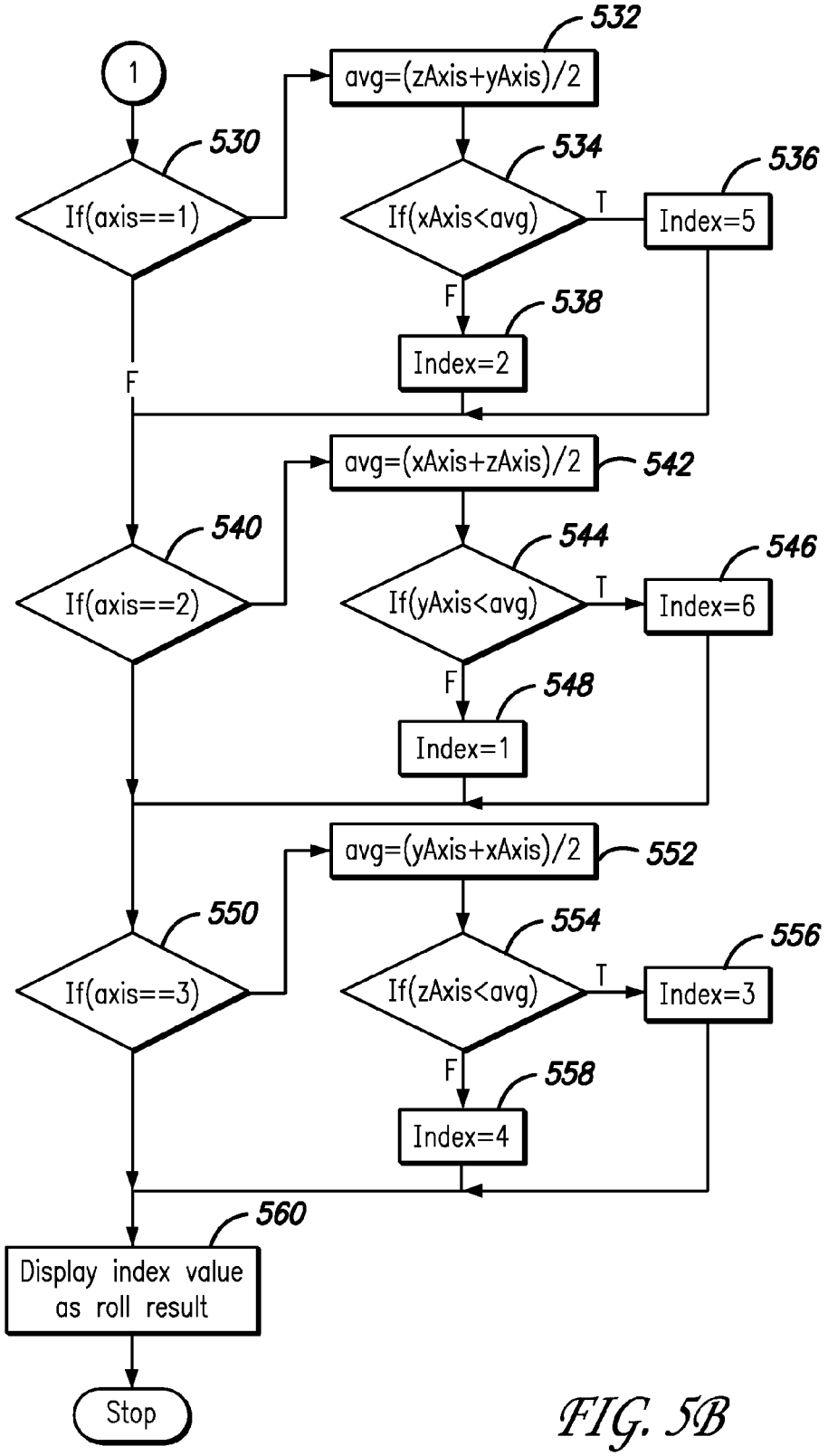

FIGS. 5A and B represent a flow chart of a power dropout compensated method 500 for determining the motion and position of a die embodiment based on accelerometer data. Method 500 starts with the capture of data from each of the x, y, and z axes in a step 504. Step 504 represents the digital capture of acceleration measurement system data. Method 500 continues with a step 506, where the delta variation between the captured data for each axis is calculated from the captured data. For an embodiment with six faces, the absolute value of the difference between the x and y, y and z, and z and x are all calculated. The absolute value of the difference between the x axis and y axis data is stored in a variable named dxy. The absolute value of the difference between the y axis and z axis data is stored in a variable named dyz. The absolute value of the difference between the z axis and the x axis data is stored in a variable named dzx.

In a step 508, an assumption is made that the y axis is the maximum value, providing a default value to an axis variable. Each of the six faces can be associated with an opposite face through an axis: a first which can be said to correspond with the second and fifth sides, a second axis which can be said to correspond with the first and sixth sides, and a third axis which can correspond with the third and fourth sides. These face descriptions can be associated with the faces of a standard die, where opposite faces always add to seven. In an embodiment, the face sides are marked with markings that equal the face descriptions. For example, the x axis can correspond to a first axis with sides 2 and 5, the y axis can correspond to a second axis with sides 1 and 6, and the z axis can correspond to a third axis with sides 3 and 4: In the next several steps, the calculated differences will be used to determine which axis of the die is now in the vertical position and to store that value to an axis variable.

Method 500 continues with a step 510. In step 510 if the value of dzx is less than the value of dxy and the value of dzx is less than dyz, method 500 progresses to a step 512 and determines that axis 2 is the axis with a vertical orientation, setting the axis variable to the value 2. Method 500 continues with a step 514. In step 514 if the value of dxy is less than the value of dyz and the value of dxy is less than the value of dzx, method 500 progresses to a step 516 and determines that axis 3 is the axis with a vertical orientation, setting the axis variable to the value 3. Method 500 continues with a step 518. In step 518 if the value of dyz is less than the value of dxy and the value of dyz is less than the value of dzx, method 500 progresses to a step 520 and determines that axis 3 is the axis with a vertical orientation, setting the axis variable to the value 3. At this point, the axis variable contains the value of the axis in the vertical position.

Method 500 continues with a step 530. In step 530, if the value of the axis variable is 1, method 500 progresses to a step 532. In step 532, the average value of the y axis data and z axis data is calculated and stored in the avg variable. This average calculates the approximate zero reading for the accelerometer. In an embodiment, the approximate zero reading as indicated in the avg variable is stored for calculating dynamic roll results. Method 500 then progresses to a step 534 where the value of avg is compared to the x axis data. If the x axis data is less than the value of avg, method 500 continues to step 536 where an index variable is set to 5. If the x axis data is not less than the value of avg, method 500 continues to step 538 where an index variable is set to 2.

Method 500 continues with a step 540. In step 540, if the value of the axis variable is 2, method 500 progresses to a step 542. In step 542, the average value of the x axis data and z axis data is calculated and stored in the avg variable. This average calculates the approximate zero reading for the accelerometer. In an embodiment, the approximate zero reading as indicated in the avg variable is stored for calculating dynamic roll results. Method 500 then progresses to a step 544 where the value of avg is compared to the y axis data. If the y axis data is less than the value of avg, method 500 continues to step 546 where an index variable is set to 6. If the x axis data is less than the value of avg, method 500 continues to step 548 where an index variable is set to 4.

Method 500 continues with a step 550. In step 550, if the value of the axis variable is 3, method 500 progresses to a step 552. In step 552, the average value of the y axis data and x axis data is calculated and stored in the avg variable. This average calculates the approximate zero reading for the accelerometer. In an embodiment, the approximate zero reading as indicated in the avg variable is stored for calculating dynamic roll results. Method 500 then progresses to a step 554 where the value of avg is compared to the z axis data. If the z axis data is less than the value of avg, method 500 continues to step 556 where an index variable is set to 3. If the z axis data is not less than the value of avg, method 500 continues to step 558 where an index variable is set to 4.

Method 500 progresses to a step 560 where the result stored in the index variable indicates the face selected by the roll of the die. In step 560, the index is displayed as the roll result. Method 500, an embodiment of a method for power dropout compensated roll measurement, is then complete. In an embodiment, the method for power dropout compensated roll measurement is performed on the electronic die. In an embodiment, the method for power dropout compensated roll measurement is performed on the device or devices that communicate with the electronic die. After the result is displayed, the die's sleep control circuitry can then determine whether the die should enter a low power mode.

By way of example, in an embodiment, the voltage reading for each output of a three-axis accelerometer is approximately 1.25 Volts plus or minus 0.25 Volts. A reading of −1 g would correspond to a voltage of approximately 1 Volt and a reading of +1 g approximately 1.5 Volts. Beginning with step 504, a measurement of the accelerometer outputs might result in the yAxis reading 1.27 Volts, the zAxis reading 1.00 Volts, and the xAxis reading 1.24 Volts. In step 506, the absolute value of the delta variation is calculated between all measurements: dxy would equal 0.03 Volts, dyz would equal 0.27 Volts, and dzx would equal 0.24 Volts. In step 508, axis would be set to the value 1. In step 510, dzx is not less than dxy, so method 500 would progress to step 514. In step 514, dxy is less than dyz and dxy is less than dyz, so method 500 would progress to step 516 and the axis variable would be set to 3. Method 500 would then progress to step 518 where the value of dyz is not less than the value of dxy. Method 500 would then progress to step 530. The value of axis would continue to be set to 3, so method 500 would progress to step 550. In step 550, the value of axis equals 3, so method 500 would progress to step 552. The average of the yAxis reading and the xAxis reading would then be taken to determine an approximate zero signal value, in this case, approximately 1.25 Volts which would be recorded in the avg variable. Method 500 then moves to step 554 where the value of zAxis reading is compared to the value of avg. If the zAxis value is less than the avg value, the index is set to 3, indicating a roll of face 3. If the zAxis value is greater than the avg value, the index is set to 4, indicating a roll of face 4. In this example, the zAxis value is less than the avg value, and the index variable would be set to 3 in step 556, indicating a roll of face 3. In step 560, the method would display the value of the index variable as the roll result, 3.

Another Example Method for Power Dropout Compensated Roll Measurement for N-Sided Die Utilizing vector math to solve for the orientation can also allow the acceleration measurement system to solve for orientation for many n-sided die embodiments. The acceleration measurement system can provide values which can be used to determine a vector representative of the effect of gravity while, or just before, the die is at rest.

A vector math calculation in combination with voltage supply calibration, along with acceleration measurement system calibration described below allows for the determination of the orientation of the die with improved accuracy.

Figure 5C:
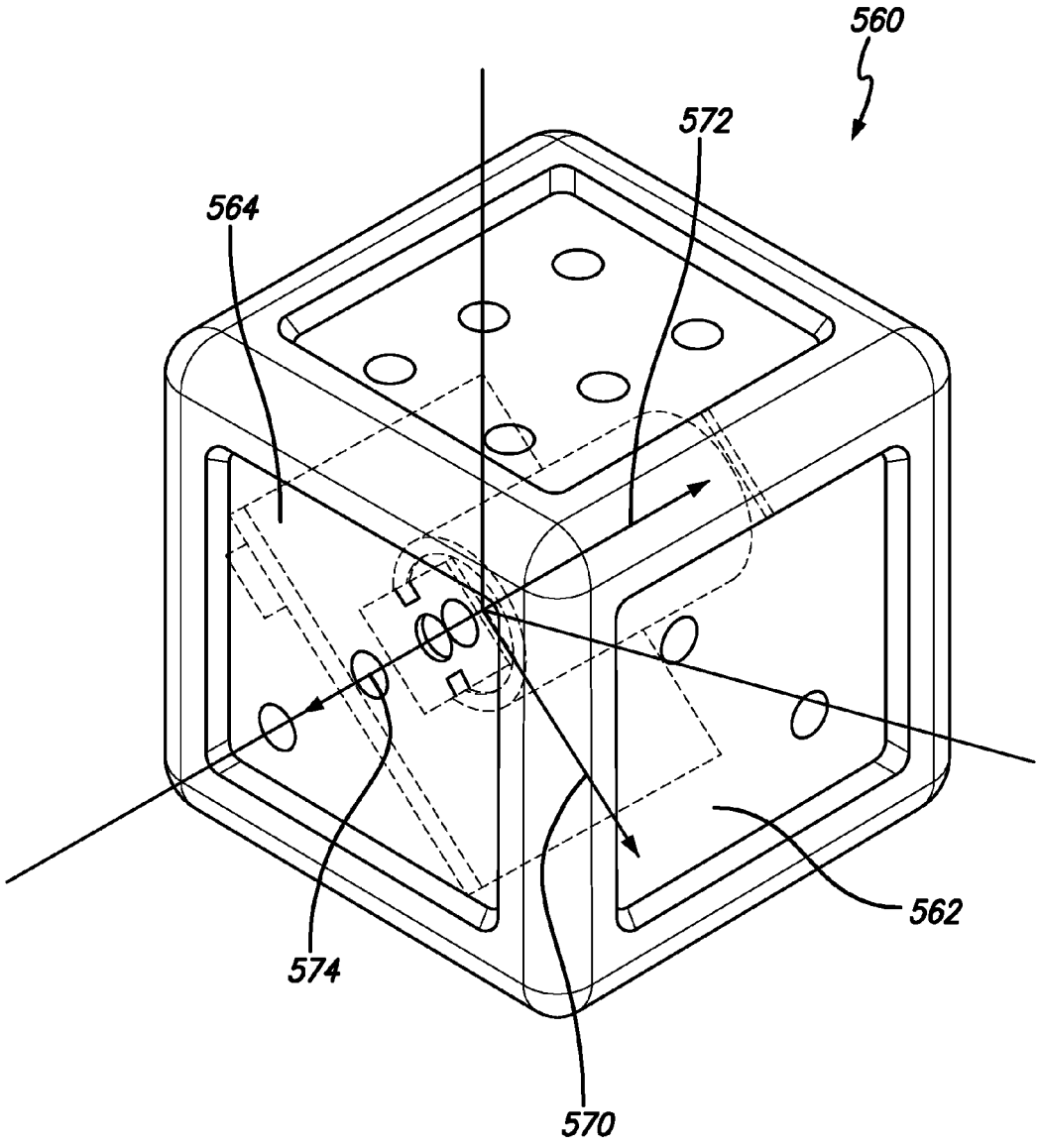
FIG. 5C illustrates the relationship of the orientation of an electromagnetic assembly of an embodiment of a cubical die at rest.

FIG. 5C represents an electronic die 560 including an enclosure 562 and an acceleration measurement system 564. In an embodiment, acceleration measurement system 564 is advantageously oriented approximately at a known angle to the enclosure. The acceleration measurement system 564 can report data relative to its x plane 570, y plane 572, and z plane 574. By calibrating the acceleration measurement system 564, for example, during manufacturing or by the user prior to game play, the relative orientation of the x 570, y 572, and z 574 planes of the acceleration measurement system to the n-sides of an n-sided die can be determined.

Figure 5D:
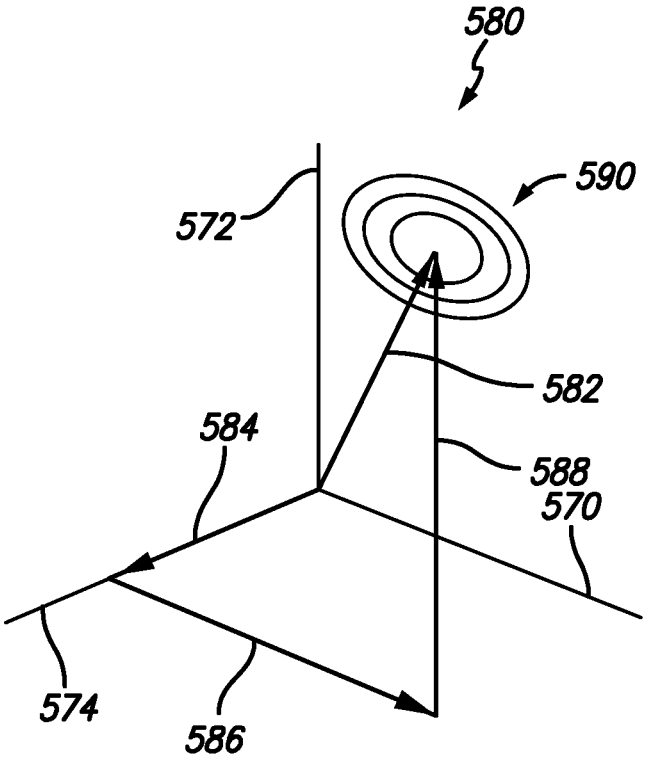
FIG. 5D illustrates the calculation of a roll for an embodiment of an electronic die.

FIG. 5D represents vectors for calculating roll results. The roll result data 580 can be calculated relative to the x 570, y 572, and z 574 planes of the acceleration measurement system. The roll result vector 582 can be determined from the z component 584, x component 586, and y component 588 of the acceleration measurement system output. Rings of accuracy 590 illustrate the acceptable error range of the calibration and calculation system for several embodiments. Smaller rings of accuracy 590 indicate that the acceleration measurement system can identify the roll results for a larger number of die sides. These concentric rings of accuracy 590, further illustrate how a roll result might be miscalculated based on tolerances of accuracy. For smaller numbers of die sides, 4-8 for instance, the accuracy can be lower than a 20-sided die and an accurate roll determination can still be made.

Figure 5F:
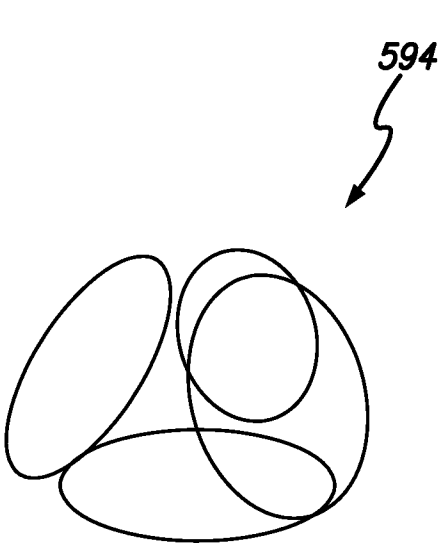
FIG. 5F illustrates the relative size of target circles for a four sided electronic die embodiment.
Figure 5E:
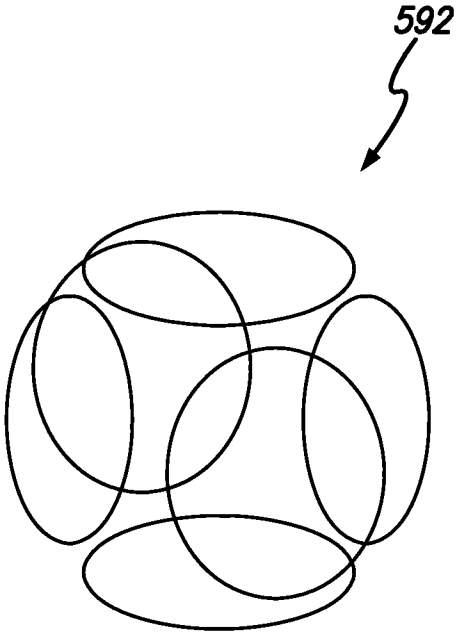
FIG. 5E illustrates the relative size of target circles for a six sided electronic die embodiment.

FIGS. 5E and 5F show how target circles 592 and 594 for identifying a particular side for changing numbers of sides of the electronic die. For a six sided die, target circles 592 are smaller than the target circles 594 for a four sided die. For applications involving additional sides, for example, n=16 or more, the target ring shrink significantly. The-rings of accuracy of the acceleration measurement system, therefore, should be smaller than the defined target circles at the normalized resultant vector magnitude in order to determine roll results. Reducing the size of the die decreases the vector magnitude of the rings of accuracy, but the target circles will shrink proportionally as well.

The vector values can be normalized, for example, by software. Using trigonometric functions, the resultant vector can be defined as a sum of products of calibrated accelerometer magnitudes. The resultant vector can be rotated by either the SIN or COS of the respective platform orientations and can accommodate the calibration values.

Orientation can be determined in a two step process. The first step includes data normalization, which results in three vector values that represent the x, y, and z axes perpendicular to the die planes. The second step includes calculation of a resultant vector of the 3 normalized vectors. This two step process, however, can be reduced to a single step.

The first step, described above, is more commonly referred to as coordinate system rotation and can be accomplished, for example, using the function below.

```
Private Function VectorAnalyze(ByVal xvec As Integer, SyVal zvec As
Integer, SyVal yvec As Integer, SyVal CenterValue As Double)
    Dim result As Integer = 0
    Dim xprime As Double
    Dim yprime As Double
    Dim zprime As Double
    Dim normXvec As Double = xvec− CenterValue
    Dim normYvec As Double = yvec− CenterValue
    Dim normZvec As Double = zvec − CenterValue
    Dim CosPi_4 As Double = Math.Cos(Math.PI /4)
    Dim SinPi_4 As Double = Math.Sin(Math.PI /4)
    Dim MajorVector As Integer = 1
    zprime = normZvec
    xprime = (normXvec * CosPL 4) − (normYvec * SinPi_4)
    yprime = (normXvec * CosPi_ 4) + (normYvec * SinPi_4)
End Function
```

In this exemplary function, x, y, and z vector values are obtained from the acceleration measurement system. The CenterValue can provide normalization information. The normalized values are calculated and then rotated as previously described to determine an xprime, yprime, and zprime. Note that in the embodiment shown in FIG. 5C, the xprime and yprime values are products of rotation based on the orientation of the acceleration measurement system. The zprime vector is already perpendicular to its plane and needs only to be normalized in terms of magnitude.

Using the resulting three axis values from step 1, a final resultant vector can be calculated. For a given number of sides, a set of target circles can be defined representing target areas for the resultant vectors. The target circles are not overlapping, but they can touch on the boundaries. The number of circles matches the number of sides of the die for particular embodiments. The final resultant vector will penetrate one of these circles and be used to determine die orientation.

In an embodiment, the acceleration measurement system provides three values which are used to determine a vector that represents the effect of gravity while the die is at rest. In an embodiment, the acceleration measurement system is oriented so that the at least one axis of the measurement system is not planar to at least one side of the die. In an embodiment, the measurement system is oriented so that at least one of its axes is approximately 45 degree angle relative to at least one of the sides of the die. In an embodiment, the electronic die has six sides and a MEMS three-axis accelerometer is mounted at approximately a 45 degree angle relative at least one side.

Acceleration Measurement System Calibration

The acceleration measurement system can have variable accuracy, for example, due to manufacturing variation and design implementation. The acceleration measurement system can be calibrated at manufacturing time or at other times, such as, by a game player. A calibration solution can take into account factors, such as, for example, the effects of environmental temperature, vibration, part tolerance, orientation of the acceleration measurement system, case design, and other factors. Calibration of sensor outputs can improve accuracy. Calibration data can be stored on the die and used, for example, to modify transmitted results to a calibrated value, or the calibration data to be transmitted to a monitoring station for use in modifying the signal after reception. In an embodiment, calibration data is stored on the die. In an embodiment, calibration data is stored on a monitoring device. In an embodiment, the acceleration measurement system provides three values used to determine a vector representative of the effect of gravity while the die is at, or approaches, rest. In an embodiment, the three values are calibrated values. In an embodiment, the roll results are calibrated results.

Accuracy of a roll result calculation can be impacted, for example, sensor output tolerance combined with analog to digital converter measurement accuracy error. To increase accuracy, component tolerance ranges and calibration can be controlled. By carefully selecting elements of the signal chain, calculation of roll results for an electronic die of 20 or more sides is possible with off the shelf hardware components.

Reduced Power (Sleep and Wake) Control

Power conservation in wireless products, particularly battery-operated wireless products, is very desirable. Various methods for power conservation result in different levels of power savings. The highest level of power savings is typically given by sleep control used in conjunction with remote interrupt driven wake-up methods. This method requires that the wireless unit only be awoken when data is ready to be sent and then returned to sleep after data transmission is complete. Other methods include time based wake-up methods.

In an embodiment, the sleep control system detects die inactivity and places the electronic die in a low power mode. The sleep control system extends the duration of use for a given power source. In an embodiment, the sleep control system extends the life of the battery power source. The sleep control system also detects die activity after periods of inactivity and wakes the electronic die, returning the electronic die from a low power mode to an operational mode. In an embodiment, the sleep control system integrates with the acceleration measurement system to wake the electronic die upon movement. In an embodiment, a user shakes the electronic die to wake it from a low power mode. In an embodiment, the electronic die has no buttons or other external user interface components. Referring to FIG. 4, in an embodiment, the sleep control includes a window comparator 420, roll stabilization delay components 424 and 436, and digital logic such as Schmidt trigger 430.

Figure 6:
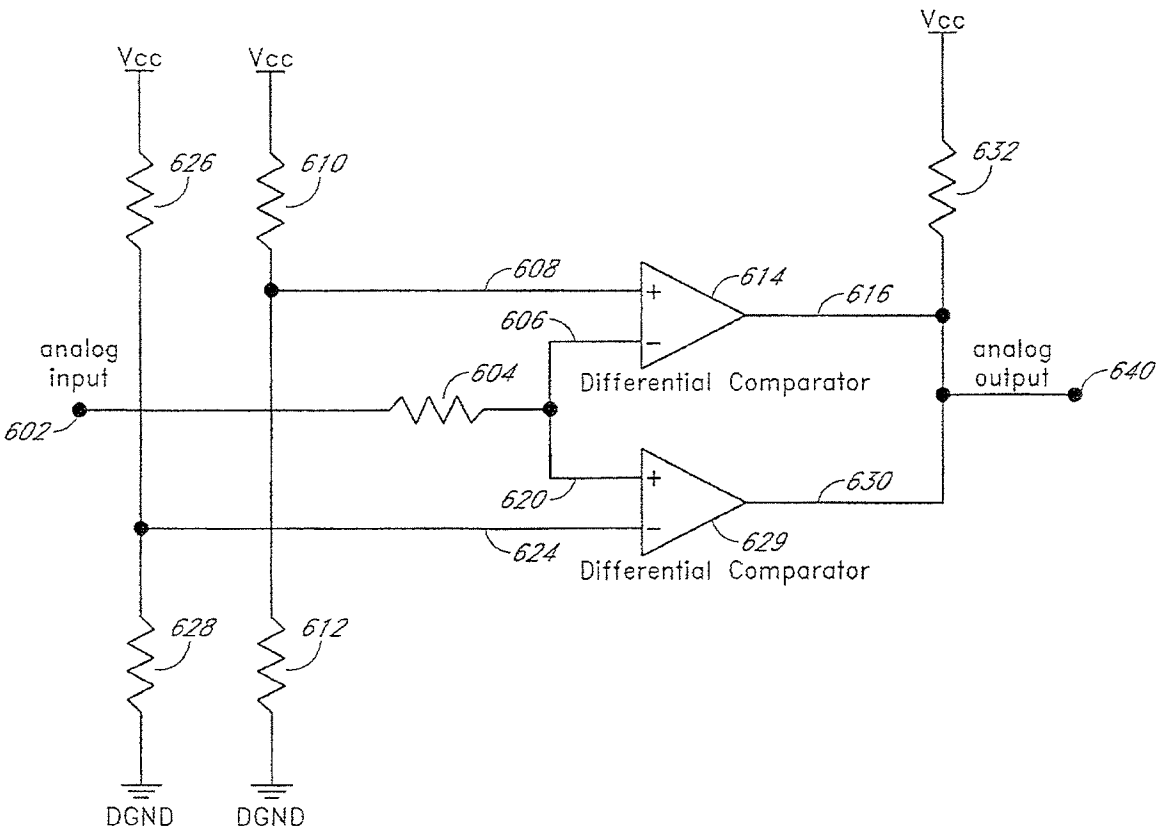
FIG. 6 illustrates an exemplary schematic diagram for an embodiment of a sleep control circuit

FIG. 6 represents a schematic diagram for an embodiment of the window comparator. The window comparator indicates if an input lies between two specified reference values or thresholds. In an embodiment, the window comparator senses any change to an input signal, the output of the accelerometer, and provides an output signal to change the power status of the electronic die. The window comparator receives an analog input 602 and produces an analog output 640. Although one input is shown, multiple inputs can be summed. In an embodiment, a separate window comparator circuit is used for each accelerometer output. In an embodiment, accelerometer outputs are summed to a single window comparator circuit.

There are three possible ranges for analog input 602: the analog input is below the lower threshold, the analog input is between the two thresholds, or the analog input is above the higher threshold. Analog input 602 is connected to high impedance resistor 604 to provide protection for the inputs 606 and 620 of the differential comparators 614 and 629. Reference voltage 608 is set by a resistive divider fanned by resistors 610 and 612. In an embodiment, reference voltage 608 is the higher voltage threshold. A first output signal 616 indicates whether the signal at input 606, and therefore at analog input 602, is a higher or lower voltage than reference voltage 608. If input 606 is a higher voltage than reference voltage 608, first output signal 616 is close to the negative supply voltage. In an embodiment where the negative supply voltage is ground, first output signal 616 is close to ground when input 606 is a higher voltage than reference voltage 608. If input 606 is a lower voltage than reference voltage 608, first output signal 616 is close to the positive supply voltage.

High impedance resistor 604 is also connected input 620 of differential comparator 629. Reference voltage 624 is set by a resistive divider formed by resistors 626 and 628. In an embodiment, reference voltage 624 is the lower voltage threshold. A second output signal 630 indicates whether the signal at input 620, and therefore at analog input 602, is a higher or lower voltage than reference voltage 624. If input 620 is a lower voltage than reference 624, second output signal 630 is close to the negative supply voltage. If input 620 is a higher voltage than reference 624, second output signal 630 is close to the positive supply voltage.

Pull-up resistor 632 ensures that given no other input, the window comparator gives a default value of high. First output signal 616 and second output signal 630 are connected as analog output 640. Accordingly, the window comparator circuit determines whether the analog input 602 is between a lower reference voltage and an upper reference voltage. In an embodiment, the output or outputs of an accelerometer are connected to the analog input 602, the window comparator determines if analog input 602 is within the reference voltages 608 and 624 to change the power state of the electronic die. When the analog input voltage exceeds the window limits, such as, for example, when the analog input is higher than the high reference voltage or when the analog input is lower than the low reference voltage, the analog output signal is driven low.

One of skill in the art will understand from the present disclosure that other circuits can perform a similar function to the disclosed window comparator circuit. Suitable circuits include, for example, digital or analog circuits that utilize the output of the acceleration measurement system to determine whether any acceleration is detected and, if no acceleration is detected, placing the electronic die in a low power mode. One of skill in the art will also understand from the present disclosure that an equivalent to this functionality could be performed in software or firmware.

Processor and Wireless Interface

The processor and wireless interface can be off-the-shelf or custom designs and can be integrated devices or separate devices. In an embodiment, an off-the-shelf integrated wireless module and processor provide the processor and wireless interface. In an embodiment, the processor and wireless interface are application specific.

The processor can be, for example, a microprocessor, microcontroller, field programmable gate array (FPGA), digital signal processor (DSP), programmable logic device (PLD), application specific integrated circuit, series of discrete digital logic, or any other suitable processor. The processor can be, for example, an 8-, 16-, 24-, or 32-bit device. In an embodiment, the processor is a microcontroller with integrated analog to digital converters.

The wireless interface can support standards-based or proprietary physical and data link protocols, such as, for example, IEEE 802.1 S, ZigBee, IEEE 802.1 SA, WiFi, IEEE 802.11 (including a/b/g/n/y or other 802.11 varieties), Bluetooth, Bluetooth HID, infrared, radio frequency, Microsoft's Xbox 360™ wireless protocol, Ultra-WideBand (UWB), wireless USB, HiperLAN/1, HiperLAN/2, Code Domain Multiple Access, Personal Communication Services, Time Domain Multiple Access, Wireless Personal Area Network (WP AN), Universal Mobile Telecommunications System (UTMS). Cellular Digital Packet Data; Wireless Local Loop, Wireless Local Area Network, Multiple Input Multiple Output, amplitude modulated (AM) radio, frequency modulated (FM) radio, or other suitable protocols. These wireless interface protocols can be implemented in off-the-shelf integrated circuits or custom devices.

The wireless interface can also be implemented in a custom radio design. In an embodiment, the wireless interface implements a listen before talk protocol that is compatible with existing listen before talk protocols such as Bluetooth or WiFi. In an embodiment, the XBEE protocol is implemented with a Carrier Sense Multiple Access (CSMA) feature that allows it to co-exist with other protocols. In an embodiment, the data rate is forced to remain high as a way of combating interference by reducing the overall time that data is transmitted.

In an embodiment, the wireless interface is designed to accept a sleep request interrupt that will allow maximum power savings by having low power circuitry determine when to power up the interface, as opposed to having the interface continuously be transmit capable, or wake up periodically to check the device status itself.

The processor and wireless interface can support a low power mode or multiple low power modes. In an embodiment, the integrated processor and wireless supports a low power mode. In an embodiment, low power mode is triggered by the acceleration measurement and sleep control module. In an embodiment, the processor triggers a low power mode.

Monitoring Device

In an embodiment, the electronic die communicates with a monitoring device. The monitoring device can be one or more of, for example. a computer, embedded system, game console, cell phone, mobile device, or other suitable device with a wireless interface. The electronic die can send real time roll updates to the monitoring device. In an embodiment, the electronic die includes an accelerometer and samples its output at a frequency that allows the electronic die to transmit roll updates in real time. In an embodiment, the monitoring device displays the roll of the dice as it occurs. The roll result can also be displayed or reported by the monitoring device.

The electronic die communicates with the monitoring device using a wireless interface, as previously discussed. The electronic die can transmit unprocessed data from the acceleration measurement system. In an embodiment, the die sends data obtained from a plurality of analog to digital converters corresponding to analog accelerometer outputs. The electronic die can also process the data prior to transmission. In an embodiment, the electronic die performs a power dropout compensated roll measurement prior to transmitting data to the monitoring device.

The monitoring device can indicate the results of the roll in a number of ways, such as, for example, video display, alpha-numeric display, a series of light emitting diodes or other lights, audible tone or speech, transmitting the results over a network, or by other suitable indication.

The data transmitted over the wireless interface between the electronic die and monitoring device follows a suitable data protocol. Suitable data protocols can include identification of the electronic die, can support a listen before talk mechanism, and can carry symbols representing data from the acceleration measurement system. A suitable protocol can, in some embodiments, describe the relationship between acceleration data and axis or provide additional features. Additional features can include, for example, encryption, diagnostics, status information, firmware version information, manufacturing data, results of embedded self testing, or other suitable features. In an embodiment, the data protocol is contained in a CSMA transmission protocol carried on an 802.15.4 wireless network. In an embodiment, the data contained in the data protocol includes the electronic die serial number. In an embodiment, the data contained in the protocol includes at least a most significant byte and a least significant byte for each accelerometer output. The data transmitted over the wireless interface or contained in the data protocol can be encrypted. The data can be encrypted with a suitable type of encryption, such as, for example, the advanced encryption standard (AES). In an embodiment, the data contained in the protocol is encrypted. The security of the wireless network can also be enhanced using techniques, such as, for example, wired equivalent privacy (WEP), Wi-Fi Protected Access (WPA), WPA2, or other suitable technique. In an embodiment, the data transmitted over the wireless interface is encrypted. In an embodiment, the wireless network is secured using encryption.

The monitoring device can also send data to the electronic die. In an embodiment, the monitoring device transmits a firmware update to the electronic die. In an embodiment, the monitoring device transmits a message that places the electronic die in a low power mode. In an embodiment, the monitoring device transmits a message that directs the electronic die to perform diagnostics. In an embodiment, the monitoring device transmits a message that directs the electronic die to restart or reset.

Multiple Dice

Features can be added to the electronic die to facilitate the simultaneous use of multiple dice. For example, dice authorized for a software application such as a game for instance can be members of a Service Set. Each die can have a unique ID, such as, for example, a Source Address that can be unique among all produced die. Utilizing this unique Source Address, packets can be filtered by hardware or software to determine the Die of Origin. All Source Addresses or Die of Origins for a game or location, can be entered into a database or memory array indicating authorized members of the Service Set.

An exemplary Service Set software implementation is shown below.

```
Public Class Dice
    Private __MyDice As New List (Of Die)
    *Add a Die to the Service Set
    Public Sub AddDie(ByVal myDie As Die)
            MyDice.Add(myDie)
    End Sub
    *Remove a Die from the Service Set
    Public Sub RemoveDie(ByVal SubId As String)
            Dim findIndex As Integer = LocateDie(SubId)
            MyDice.RemoveAt(findIndex)
    End Sub
    *Test a received DeviceId to sec if it's a member of the Service Set
    Public Function IsAuthorized(ByVal DeviceId As String) As Boolean
        Dim result As Boolean =False
        Dim RegisteredDevice As Die
        For Each RegisteredDevice In __MyDice
            If RegisteredDevice.DevId = DeviceId Then
                result=True
            End If
        Next
        Return result
    End Function
End Class
```

Security Features

Security features can be added to the device to reduce the likelihood of falsely reported roll results or data. For non-professional applications, basic mechanisms for determining packet origin, as previously described, can be acceptable. For added security, a second non-unique ID can be added which can be used modified by the game owners to help prevent, for example, spoofing. Spoofing is otherwise known as a Man in the Middle (MITM) attack. A MITM attack can be successful, for example, when the attacker can impersonate an endpoint to the satisfaction of the other. Cryptographic protocols can include some form of endpoint authentication reduce the likelihood of MITM attacks. This second code can be changed frequently using automated means to help prevent spoofing. In an embodiment, the user enters a second ID. In an embodiment, the user can change the second ID. These codes can be updated manually or automatically.

The second ID code can be update wirelessly or in a hardwired fashion. A wireless update might be less secure and could potentially allow a snooper to obtain the second ID code. A physical hardwire connection method can be more secure for updating the code and help to prevent MITM attacks. In an embodiment, the second ID code is updated manually. In an embodiment, the second ID code is updated wirelessly. In an embodiment, the second ID code is updated using a hardwire connection.

Rolling code security can also be used to update a second ID code. In an embodiment using rolling code security, a known key is shared between each die in the Security Set. Unique keys can be utilized for each member of the Security Set. The rolling code can be updated based on a synchronized clock either generated on the die hardware, or transmitted by a monitoring device or base station. In an embodiment, the die includes a real time clock for managing rolling code functions.

In an embodiment, 2 key security is employed. In a 2 key security embodiment, a function can be created that includes 3 variables: the first variable is the manual key, and second variable is a key transmitted by the monitoring device or base station, the third variable is an encoded version of the sensor data. When processed through the function a value is generated that is the product of the encoded data, manual key and the monitoring device or base station key. The base station or monitoring device can be aware of the manual key, and of the last key transmitted to Security Set members, so it can decrypt the encoded data.

A low level snooper might have access to the transmitted key, for example, but is not likely to have access to the manual key, or the raw encoded data or the function that manipulated the data before transmission. These features might make the security reasonable for home gaming or professional gaming. Other security features, now known, or later discovered, may be added to the electronic device, for example, to allow use in professional gaming systems.

Protective Cover and Faceplates for Electronic Dice

Embodiments of the present disclosure provide a configurable electronic game piece and protective barrier between an object against which a game piece can come into contact and the game piece itself. Allowing a user to configure an electronic game piece can allow, for example, enhanced game play, customizable appearance, adaptability to different games, and other functions. Electronic game pieces can be configured according to embodiments described herein, for example, by changing faceplates, protective covers, other accessories, or the like. While disclosed generally with reference to an electronic die, an artisan will recognize from the disclosure herein that the embodiments of disclosure herein may advantageously be applied to portions of other electronic game pieces.

Figure 7:
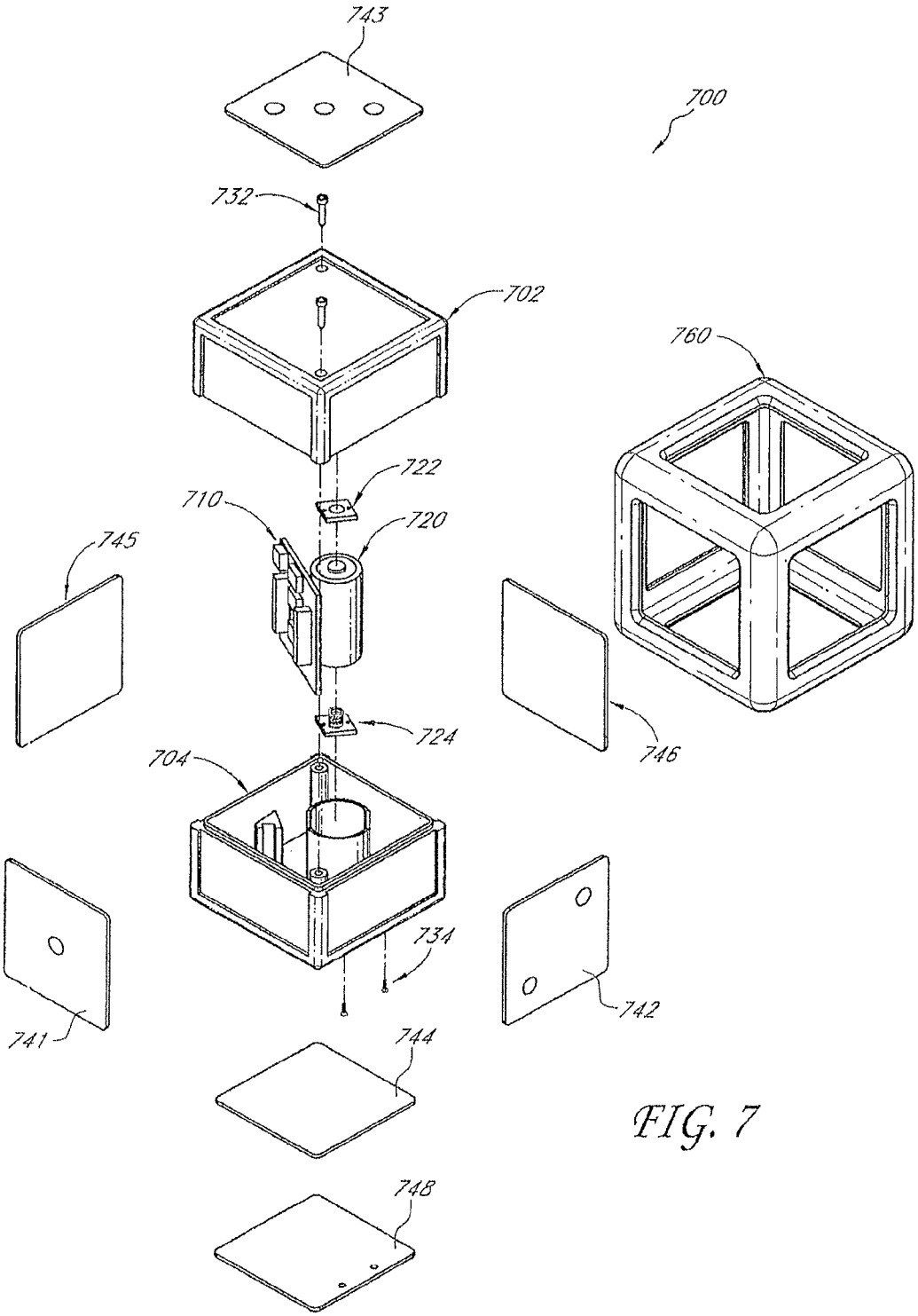
FIG. 7 illustrates an exploded assembly view of an embodiment of an electronic die.

FIG. 7 is an exploded assembly view of an embodiment of an electronic die 700. As shown in FIG. 7, electronic die 700 includes an upper casing 702 and a lower casing 704. Die 700 includes an enclosure formed by the upper casing 702 and the lower casing 704. The enclosure includes a cavity, battery support, electromechanical assembly support, and mechanical coupling. The enclosure cavity allows for the insertion of electromechanical assembly 710. Electromechanical assembly 710 can include, for example, one or more printed circuit boards with associated components, components connected through cabling, power sources, or other suitable assemblies. Electromechanical assembly 710 can also be encapsulated by an enclosure cavity on the upper casing 702 of the die. Enclosure cavities also allow for weight balancing either through the addition or subtraction of material.

Electromechanical, assembly 710 and power source 720 can interface with an electromechanical assembly support and battery support. In an embodiment, upper casing 702 includes similar features to those shown in lower half 704. Power source 720 can also interface electrical contacts 722 and 724.

Upper half 702 can also include holes 236 allowing screws 732 to interface mechanical coupling, securing the enclosure. Other configurations of mechanical couplings are also contemplated, such as one screw passing through a hole in the upper half 702 with another screw passing through the lower half 704, or the like. In other embodiments, the mechanical couplings are a pair of cantilever snap fits, however, as previously discussed, other suitable mechanical couplings can be used in addition to, or as replacements for, the illustrated mechanical couplings. Combinations of mechanical couplings can also be used to couple the die casing. As shown by the embodiment of FIG. 7, electromechanical assembly 710 can be mounted at an angle to one or more sides of the enclosure.

The electronic die 700 can also include charging contacts 734. Charging contacts 734 can allow charging of the power source 720 without dissembling electronic die 734. In an embodiment, electrical contacts 722 and 724, power source 720, and charging contacts 734 form at least part of a circuit for interfacing an external charger for power source 720. Alternatively, power source 720 can be charged through other methods, as disclosed herein, such as, for example, inductive charging or shaking.

In the embodiment shown in FIG. 7, electronic die 700 also includes a number of faceplates 741-748. Each of the faceplates 741-748 corresponds to one of the six sides of the enclosure. Additional features of the faceplates are disclosed below. In an embodiment, one or more of the faceplates can include one or more charging features, such as the pass-through holes of faceplate 748, Electronic die 700 can also include a jacket or protective cover 760. Additional features of the jacket or cover 760 are disclosed below.

When assembled, the embodiment of a customized electronic game piece 700 shown in FIG. 7 will be a six sided die. The die includes six faceplates: a first 741, second 742, third 743, fourth 744, fifth 745, and sixth 748 (collectively faceplates). As previously discussed, each of the faceplates has two sides which can be user changed. The enclosure formed by upper half 702 and lower half 704 can have indicia for matching or aligning faceplates. In an embodiment, game piece enclosure is a six-sided gaming die. In an embodiment, indicia for matching faceplates are pips on the game piece enclosure. In an embodiment, indicia for matching faceplates are numbers printed on the enclosure. In an embodiment, indicia for matching faceplates are colors. In an embodiment, indicia for aligning faceplates are shapes.

In an embodiment, the enclosure is designed specifically to receive faceplates and/or a jacket or protective cover 760. The enclosure can also include features to help secure faceplates and/or the jacket 760. Features that might help secure faceplates and/or jackets include cavities, pockets, recesses, edges, magnets, metals, snaps, fittings, hook and loop tape, adhesives, combinations of the preceding, or the like. In an embodiment, faceplates snap fit into the enclosure. In an embodiment, faceplates are magnetically attached to game the enclosure. In an embodiment, edges of the enclosure secure game piece cover 760.

In an embodiment, a user attaches faceplates and jacket 760 to the die 700. The attachment order can depend on specific aspects of the design of one or more of the features of die 700. In an embodiment, a user stretches at least one side of jacket 760 to insert the enclosure. In an embodiment, faceplates are inserted within the jacket 760. In an embodiment, jacket 760 is snap fit around the enclosure. When assembled as shown electronic die 700 is ready for game play, such as, for example, being rolled or placed.

In an embodiment, jacket 760 includes numerical indicia for matching faceplates. In an embodiment, jacket 760 includes mechanical indicia for matching faceplates. In an embedment, jacket 760 includes a rigid support structure and protective bumpers. In an embodiment, jacket 760 is a plastic structure adapted to receive faceplates.

Figure 8A:
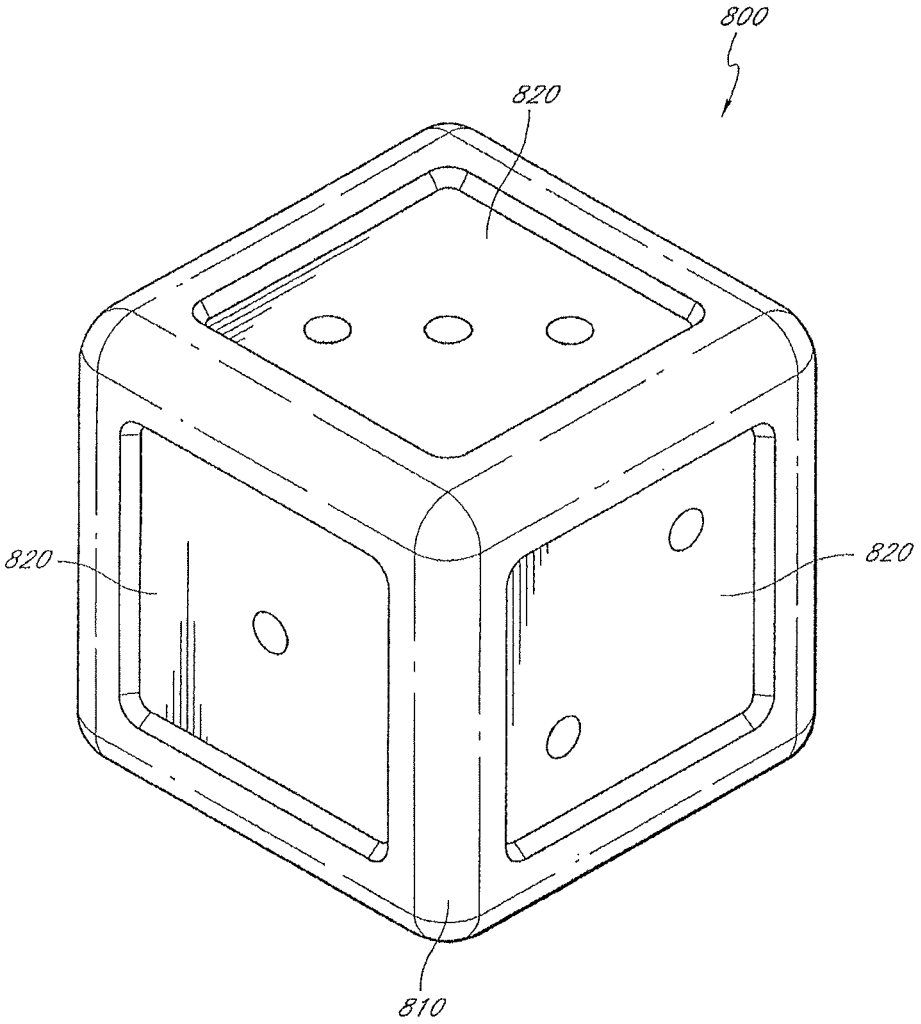
FIG. 8A illustrates a top perspective view of an exemplary embodiment of an assembled electronic die with faceplates and a protective cover.

FIG. 8A represents an embodiment of a configured game piece 800 with a protective cover 810 and faceplates 820. In the embodiment shown in FIG. 8A, the game piece is a six sided gaming die. The faceplates 820 illustrated in FIG. 8A include pips indicating unique numerical values for each of the six sides. The protective cover or jacket 810 and faceplates 820 can include additional features as more fully described below. The protective cover 810 and jacket 820 can be used together in some embodiments, or used independently in other embodiments. In an embodiment, the configured game piece 800 is a gaming die with a protective cover 810. In an embodiment, configured game piece 800 is a gaming die with faceplates 820.

Figure 8B:
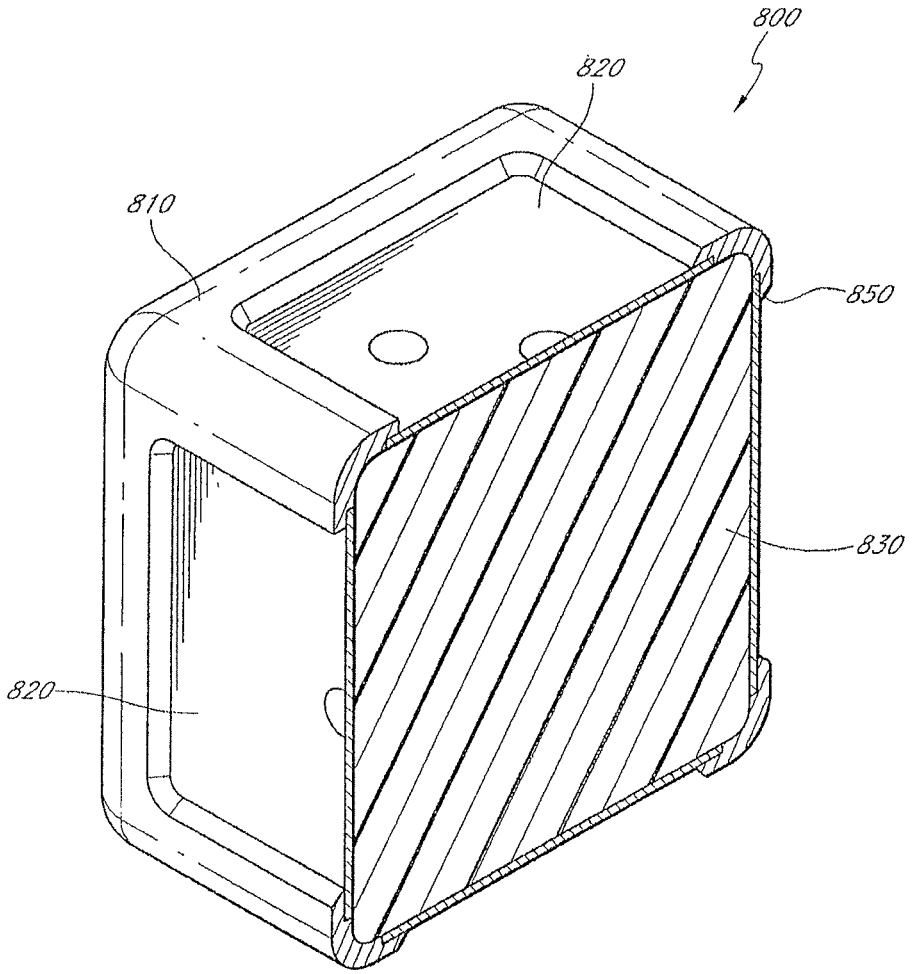
FIG. 8B illustrates a cross-sectional view of an exemplary embodiment of an assembled electronic die with faceplates and a protective cover.

FIG. 8B represents a cross-sectional view of the embodiment of FIG. 8A. As shown, configured game piece 800 includes a game piece 802, protective cover 810, and faceplates 820. FIG. 8B also shows an embodiment of an attachment mechanism 850. Jacket 810 can cover at least a portion of faceplates 820 to attach them to game piece 802 as shown by attachment mechanism 850. Faceplates 820 can also be attached to the game piece 802 in a number of ways, including, for example, using features of the game piece 830 or jacket 810. The attachment can be, for example, snap, friction, compression, magnetic, adhesive, or other suitable attachment.

Embodiments of a configured game piece 800 need not include all of the elements shown in FIGS. 8A-8B. In an embodiment, configured game piece 810 includes a gaming die game piece 830 with a protective jacket 810. In an embodiment, configured game piece 810 includes a gaming die game piece with faceplates 820. In an embodiment, configured game piece 800 is a protective jacket 810 and faceplates 820. Additional details regarding aspects of the configured game piece are disclosed below.

Protective Cover

Embodiments of the present disclosure seek to provide a protective barrier between an object against which a game piece may come into contact and the game piece itself. While disclosed generally with reference to a die, an artisan will recognize from the disclosure herein that the protective barriers consistent with the disclosure herein may advantageously be applied to any edge or portion of any game piece.

A protective cover or jacket can surround at least a portion of a game piece. Protective covers can serve functions such as, for example, protecting game pieces, protecting other objects from game pieces, secure aspects or accessories to game pieces, altering the texture of game pieces, changing interaction of game pieces with surfaces, or other suitable functions. In an embodiment, a protective cover protects a die from a roll surface. In an embodiment, a protective cover protects a roll surface. In an embodiment, a protective cover secures an accessory to a game piece. In an embodiment, a protective cover includes a texture, pattern, or material that allows the game piece to be identified by touch or sight. In an embodiment, a protective cover for a die changes the roll characteristics of the game piece.

A protective cover can be sized to fit existing game pieces, custom game pieces, or can provide structure to for a game piece. In an embodiment, a protective cover is sized to fit an existing die.

The fit of the protective cover can be loose, tight, or loose in some dimensions while being tight in other dimensions. One or more portions of the protective cover can stretch, for example, to allow the protective cover to be placed on a game piece. The protective cover can be soft, medium, or hard. In an embodiment, the protective cover is softer than the game piece. In an embodiment, the protective cover is harder than a game surface. In an embodiment, the protective cover is softer than a game surface. The protective cover can have uniform or varying thickness. In an embodiment, a protective cover is uniformly thick. In an embodiment, a protective cover is thicker above game piece edges.

Embodiments of the protective cover disclosed herein may be disposable per use, may be adapted for long term application, may comprise a pliable jacket, may comprise a harder plastic cover, may be of any material such as, without limitation, wood, metal, plastic, cardboard, glass, fabric or leather may comprise multiple components, may be transparent to allow the original finish of the game piece to be visible or be colored, may be assembled by the user, combinations of the same or the like. It will be apparent to an artisan from the disclosure herein that a large number of different shaped protective covers may be applied to, for example, a game piece. For example, a pliable protective jacket may be stretched over the game piece. Alternatively, a harder plastic cover may be hingably applied, may comprise multiple components that snap fit together, or the like. In various embodiments, the protective cover may comprise a transparent material providing view of the finish of the game piece.

Figure 9:
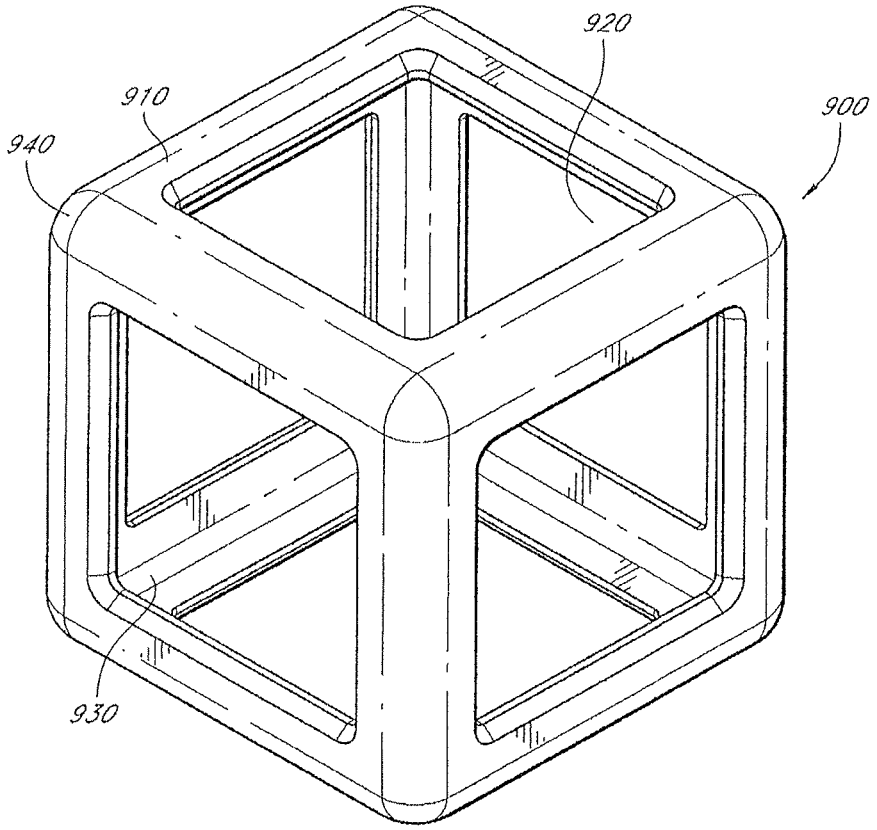
FIG. 9 illustrates an exemplary embodiment of a protective cover for an electronic die.

FIG. 9 represents an embodiment of a protective cover 900. As shown in FIG. 9, protective cover 900 includes an outside surface 910, one or more recesses 920, and an inside surface 930. As shown in the embodiment of FIG. 9, the cover 900 surrounds one or more edges or extremities of the game piece. An artisan will recognize from the disclosure herein that an extremity, protrusion, or other feature of the game piece, for example, are some of many places that are subject to wear and prime positions to apply the protective cover 900, even though the cover 900 is illustrated for convenience as applied to a die. In an embodiment, protective cover 900 includes rounded edges and corners 940. In an embodiment, protective cover 900 is a rubber protective jacket. In an embodiment, a protective cover 900 encourages better rolling by, for example, increasing the grip on a rolling surface. In an embodiment, a protective cover 900 approximately maintains the center of gravity of the game piece. In an embodiment, a protective cover 900 includes raised edges. In an embodiment, raised edges on a protective cover surrounds a game piece with three dimensional surface features.

As shown in FIG. 9, the cover 900 comprises six sides and a top surface, forming a substantially cubical shape having a open sides 920 for accepting a protruding edges of a game piece, such as, for example, a gaming die. The cover 900 may advantageously comprise a pliable material enabling it to stretch and pull over a particular edge. Moreover, the cover 900 may advantageously be pre-shaped or capable of shaping by the user, such as tape from a roll into a shape generic to a wide variety of game pieces, into a shape generic to a series or a plurality of series of game pieces, into a shape generic for a manufacturer or a plurality of manufactures, into a shape specific to a particular game piece, or game piece portion, combinations of the same or the like.

Outside surface 910 and inside surface 930 can be constructed from dissimilar materials or have different characteristics. For example, outside surface 910 may be a softer material than inside surface 930. In an embodiment, the outside surface 910 material is advantageously chosen to protect objects other than the game piece. In an embodiment, the inside surface 930 is advantageously chosen to protect the game piece. In an embodiment, protective cover 900 comprises a substantially transparent material. In an embodiment, protective cover 900 comprises a substantially translucent material.

In an embodiment, aspects outside surface 910 or inside surface 920 are advantageously selected for roll performance on a smooth surface. In an embodiment, aspects of outside surface 910 are advantageously selected for roll performance on a rough surface. Outside surface 910 and inside surface 930 of protective cover 900 also can be reversible. In an embodiment, protective cover 900 is reversible. In an embodiment, outside surface 910 is a different color than inside surface 930. In an embodiment, aspects of outside surface 910 are advantageously selected for roll performance on a surface while aspects of inside surface 930 are selected for roll performance on another surface.

One or more recesses 920 provide a view of the game piece. Recess 920 can be an opening that exposes portions of the game piece. In an embodiment, recess 920 comprises a substantially transparent material. In an embodiment, recess 920 comprises a substantially translucent material. In an embodiment, a jacket for a die includes a recess 920 for each face. In an embodiment, recess 920 is a cavity that exposes portions of a game piece. In an embodiment, recess 920 is a cutout. In an embodiment, one or more of the recesses 920 are comprised of different colors than the outside surface 910. In an embodiment, recess 920 is comprised of a different material than outside surface 910. In an embodiment, protective cover 900 includes indicia for alignment with a game piece, faceplates, or other accessories.

Protective cover 900 can include rounded edges and corners 940. Rounded edges and corners 940 can, for example, help protect the game piece or nearby objects from damage. The edges and corners 940 can be made of a material advantageously selected to provide protection to high wear or contact areas of the game piece. In an embodiment, edges and corners 940 comprise additional thickness. In an embodiment, edges and corners 940 are comprised of a material different from the remaining portions of protective cover 900.

The cover 900 may advantageously comprise a shape and a material that is applied to the game piece in a disposable, semi-permanent or even permanent manner. For example, the cover 900 may advantageously comprise a pliable plastic that can be stretched to form fit over the game piece. In other embodiments, the cover 900 may advantageously be customized to a particular taste, to a particular shape, color, pattern, material, suited to protect a different portion of the game piece, or combination thereof. In an embodiment, when the cover 900 is scratched or damaged, the cover 900 is advantageously discarded and another cover could be applied. The materials chosen for any aspect of protective cover 900 can also be advantageously chosen for other properties, such as, for example, to be substantially transparent to wireless signals that could be sent from or received by the game piece.

As shown, the cover 900 can be secured through, for example, a friction fit, such that any wear will occur to the cover 900 as opposed to the extremity of the game piece. The cover 900 can also be secured using, for example, example hook-and-loop materials, snaps, buckles, bumps, velcro, an adhesive or the like.

Although disclosed as a jacket for a particular die, an artisan will recognize form the disclosure herein that the cover 900 may advantageously be fitted to protect a smaller portion, corner, curve, surface, protrusion, or the like, or be capable of protecting larger portions or surfaces, or even entire game pieces. The cover 900 can also be comprised of multiple pieces.

Faceplates

One or more faceplates can provide further functionality of the electronic game pieces described in the present disclosure. Faceplates can serve functions such as, for example, protecting game pieces, protecting other objects from game pieces, secure aspects or accessories to game pieces, altering the texture of game pieces, changing interaction of game pieces with surfaces, or other suitable functions. Faceplates can allow game pieces to have different themes or styles. Players can swap them out for other to adapt game pieces to additional games.

For example, a six-sided die normally include six faces. By providing removably attachable plates to the six faces, additional face possibilities become possible. A removable faceplate can, for example, have different indicators on each side. The reversibility of certain embodiments of the faceplates can provide additional aspects of game play. The faceplates can contain different themes for different games on different sides. Game play can involve using both sides of a faceplate. For example, a user could change side of a faceplate based on game play results or actions. In an embodiment, faceplates can keep track of player states. In one popular game, Trivial Pursuit®, players keep track of whether they have met a certain goal by filling in one or more pieces of a pie. Faceplates could, for example, track a player's state in a similar manner.

Reversible faceplates on a die can have the same image on one side and unique images on a second side. In some games, game play could begin with the common images showing on each die face. Based on game play or a player decision, a choice could be made whether to reveal the hidden unique image on the second side of faceplate.

Figure 10A:
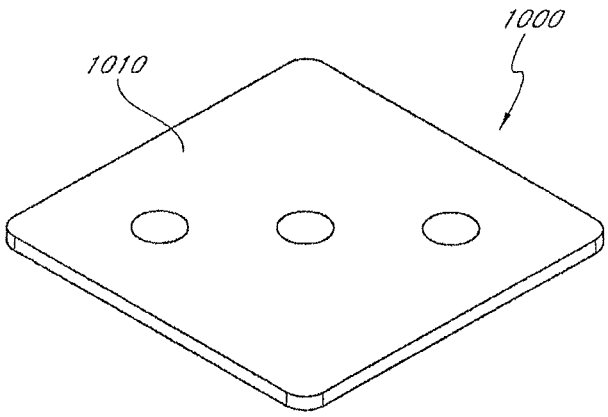
FIGS. 10A-C illustrate exemplary embodiments of faceplates for an electronic die.
Figure 10B:
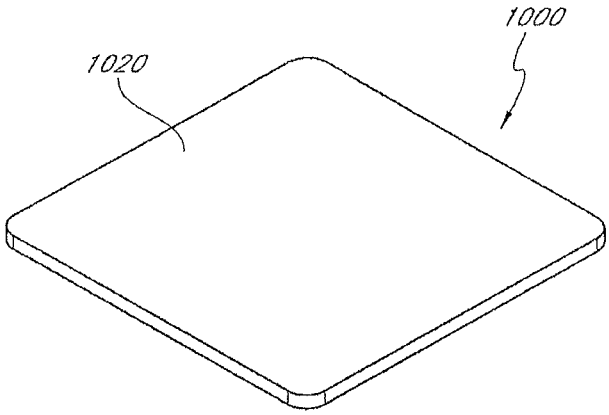

FIG. 10A represents an embodiment of a faceplate 1000. A first side 1010 is shown with pip indicators in the embodiment of FIG. 10A. The first side 1010 can include indicators such as, for example, markings, numbers, symbols, colors, points, lines, pictures, illustrations, logos, characters, words, graphics, electronics, light emitting diodes, liquid crystal displays, other representations, combinations of the foregoing, or the like. In an embodiment, a faceplate includes a dynamic display, such as, for example, an LED or LCD display. FIG. 10B represents a second side 1020 of a faceplate 1000. The second side 1020 can also include indicators as described for the first side 1010. The indicators on the second side 1020 can be the same as or different from the indicators on the first side 1010. In an embodiment, the first side 1010 has different indicators from the second side 1020. In an embodiment, the first side 1010 indicators are pips. In an embodiment, the markings on the first side 1010 are substantially similar to the markings on the second side 1020. In an embodiment, the color of an indicator on the first side 1010 is different from a color of an indicator on a second side 1020. In an embodiment, the indicators on the first side 310 are pips and the indicators on the second side 1020 are symbols.

Figure 10C:
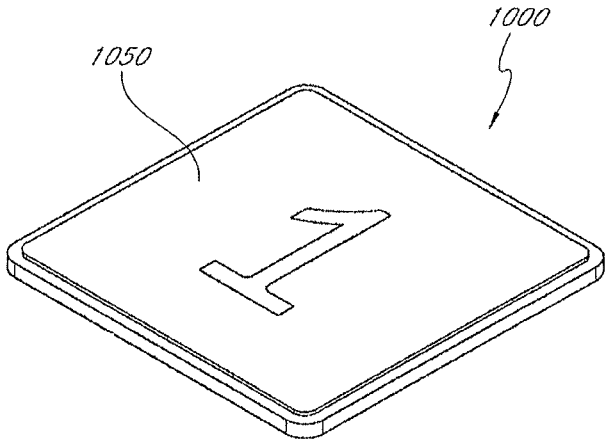

FIG. 10C represents another embodiment of a faceplate 1000. Faceplate 1000 can include user changeable accessory 1050. Accessory 1050 can include, for example, stickers, labels, inserts, magnets, or the like. In an embodiment, accessory 1050 is a plastic insert. In an embodiment, accessory 1050 is a sticker. In an embodiment, accessory 1050 is configurable by a user. In an embodiment, accessory 1050 is a computer printed label. Accessory 1050 can removably attach to one or more sides of faceplate 1000. In an embodiment, different accessories are used on each side of a faceplate 1000. In an embodiment, accessory 1050 is adapted to receive user marking.

The faceplates 1000 can also have indicia, for example, to aid in alignment or to identify the portions of a game piece with which they should be associated. The indicia can be, for example, mechanical interfaces, alphanumerical identifiers, shapes, colors, patterns, magnetic attraction, fittings, sizes, or other suitable indicia. In an embodiment, faceplate 1000 includes an alphanumeric identifier of a corresponding die side. In an embodiment, faceplate 1000 includes a mechanical interface for identifying a corresponding die side. In an embodiment, faceplate 1000 is shaped to fit a particular aspect of a game piece. In an embodiment, faceplate 1000 has a colored edge to identify a corresponding aspect of a game piece. In an embodiment, faceplate 1000 has a shaped corner that corresponds to an aspect of a game piece.

Faceplate 1000 can also have features that allow underlying game pieces to interact with other objects. In an embodiment, faceplate 1000 includes a pass through for charging an electronic game piece. In an embodiment, faceplate 1000 is substantially transparent at radio frequencies. In an embodiment, faceplate 1000 is advantageously made of a material that allows inductive charging of an electronic game piece.

Although the faceplates 1000 shown in the embodiments of FIGS. 10A-10C are substantially symmetrical and square, the faceplates can be shapes such as, for example, rectangles, circles, ellipses, polyhedrons, or other suitable shapes including without limitation asymmetrical shapes.

Training Features

Faceplates and/or protective covers can also be aligned or matched using software. For example, software might ask a user to rotate the die so that a certain face is in a particular orientation. In an embodiment, the user enters the current configuration of the faceplates and/or jacket. In an embodiment, a training feature describes to the user how to orient the faceplates and/or jacket. In an embodiment, the faceplates and/or protective covers include alignment aids that allow the die to discover their orientation. For example, faceplates can include a material that can be detected electronically, such as, for example, a printed circuit board, metal, conductive material, combinations of the previous, or the like. In an embodiment, an electronic die includes detectors. In an embodiment, detectors include, contact pins arranged in a pattern to detect faceplates. In an embodiment, a copper pattern on the faceplate indicates the faceplate's orientation. In an embodiment, a binary numbering system in imprinted on a faceplate that can be detected by an electronic die. In an embodiment, a faceplate includes a material that changes state when a current is passed through it. In an embodiment, electrical connectors on the electronic die could cause the faceplates to change state when current is passed through a material on the faceplate. In an embodiment, electrical connectors on the die can identify a faceplate by measuring a voltage or current passed through one or more conductors on a faceplate. In an embodiment, a faceplate changes color when a current is passed through it. In an embodiment, a faceplate changes its appearance based on its position on the die. In an embodiment, a faceplate includes a display that can change appearance.

Combination of Faceplates and Protective Covers

Faceplates and protective covers described herein can be used together. As previously discussed, protective covers can include features to help attach or secure faceplates. Faceplates can also include features to help attach or secure protective covers.

Figure 11:
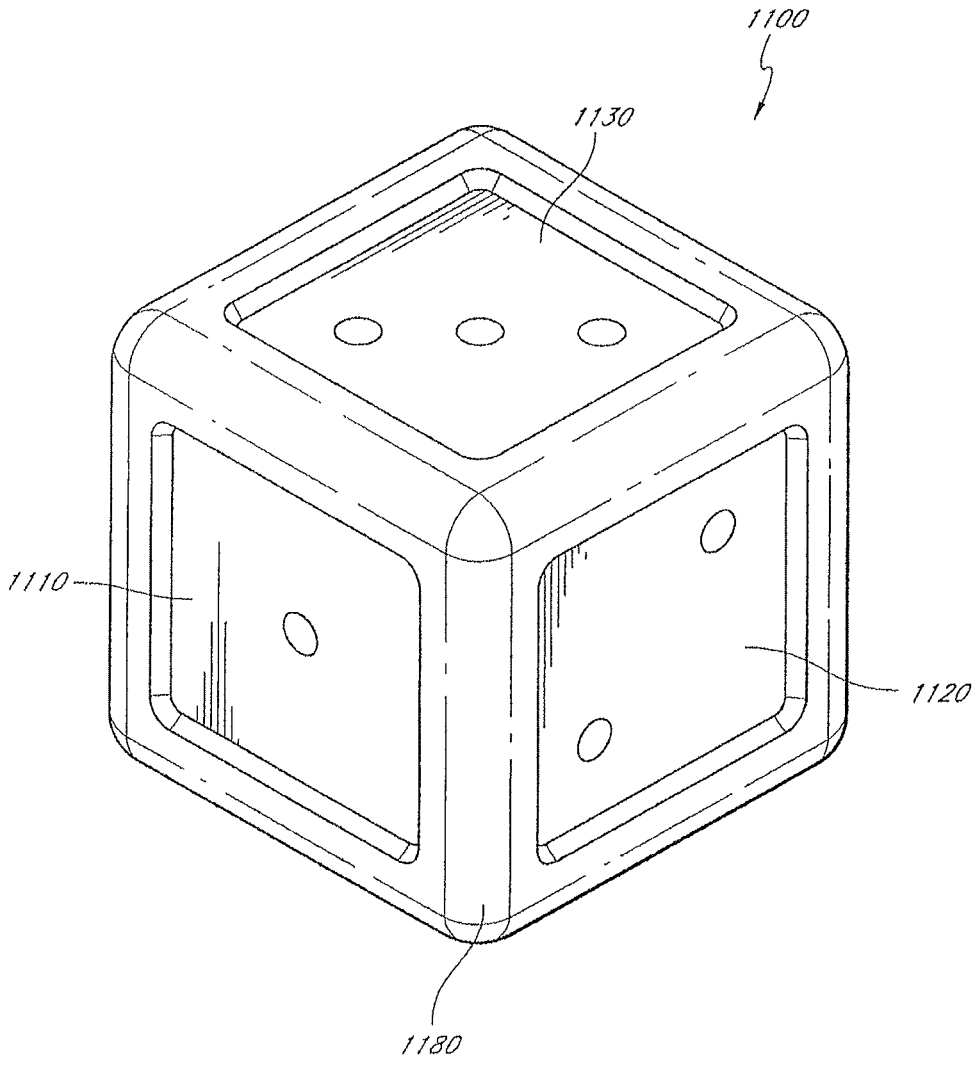
FIG. 11 illustrates a top perspective view of an exemplary embodiment of an assembled electronic die with faceplates and a protective cover.

FIG. 11 illustrates an embodiment of assembled customized electronic die 1100. The embodiment of FIG. 11 shows a first faceplate 1110, a second faceplate 1120, and a third faceplate 1130 and a jacket 1180. A user can change one or more of the faceplates as previously discussed. In an embodiment, a faceplate includes flexible edges. In an embodiment, a faceplate includes flexible edges to help a user easily remove, flip, replace, or otherwise position the faceplate. When assembled as shown in FIG. 11, the customized game piece is ready for game play, such as, for example, being rolled or placed.

Figure 12:
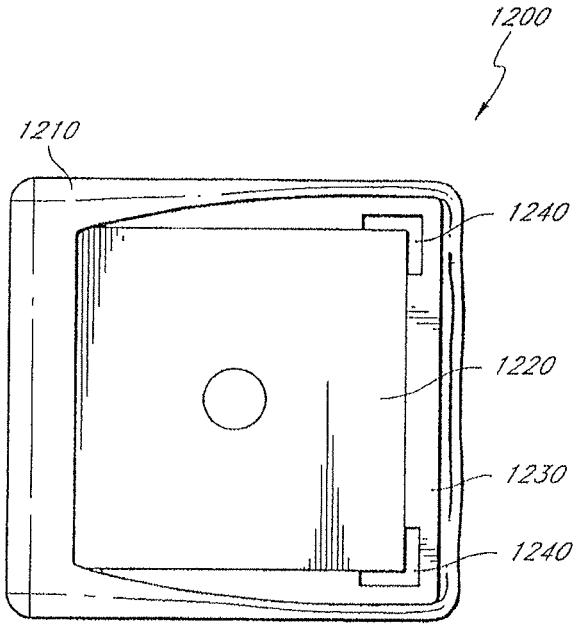
FIG. 12 illustrates a top view of an exemplary embodiment of an electronic die, protective cover, and faceplates with faceplate changing aids.

FIG. 12 illustrates an embodiment of a game piece 1200 including a cover 1210, faceplate 1220, game piece core 1230, and one or more attachment aids 1240. Attachment aids 1240 can, for example, allow a user to easily remove faceplate 1220, secure jacket 1210, or serve other suitable functions. In an embodiment, attachment aids 1240 are cavities. In an embodiment, cavities are sized to allow a user's finger or fingernail to grasp a corner of faceplate 1220. In an embodiment, one or more attachment aids 1240 are located closer to the center of one or more edges of faceplate 1220.

Other Game Pieces

Although disclosed primarily with reference to six sided die, an artisan will recognize from the disclosure herein that the faceplates and protective covers can be adapted for used on a large number of game piece shapes and types. Some additional exemplary game pieces are identified in FIGS. 13-16, although these additional game pieces are not intended to limit the disclosure to these shapes.

Figure 13:
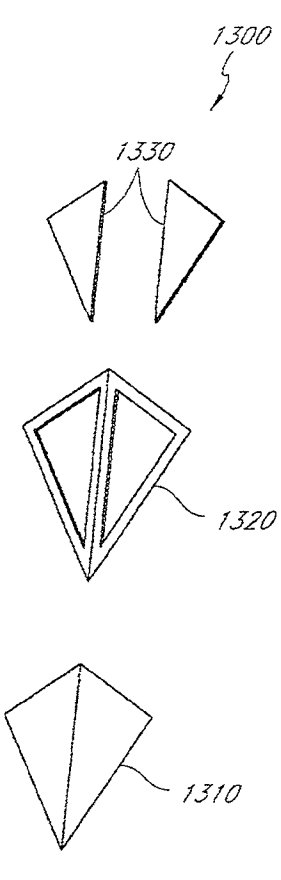
FIG. 13 illustrates an embodiment of an enclosure, protective cover, and faceplates for a tetrahedron electronic die.

FIG. 13 represents an embodiment of an electronic game piece 1300 based on a tetrahedron shape. Electronic game piece 1300 can include a game piece core 1310, protective cover 1320, and faceplates 1330 for a tetrahedron die. In an embodiment, electronic game piece 1300 is a tetrahedron die.

Figure 14:
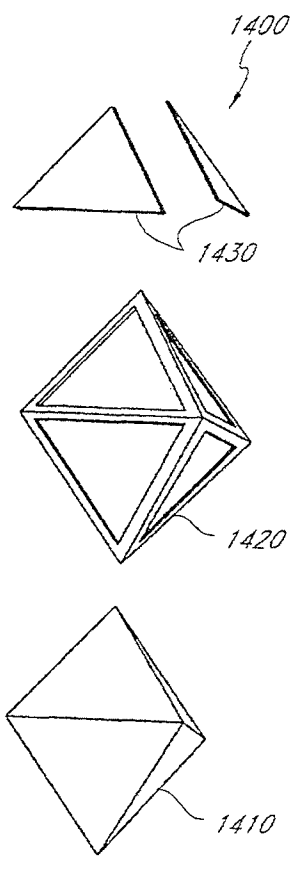
FIG. 14 illustrates an embodiment of an enclosure, protective cover, and faceplates for an octahedron electronic die.

FIG. 14 represents an embodiment of an electronic game piece 1400 based on an octahedron shape. Electronic game piece 1400 can include a game piece core 1410, protective cover 1420, and faceplates 1430 for an octahedron die. In an embodiment, electronic game piece 1400 is an octahedron die.

Figure 15:
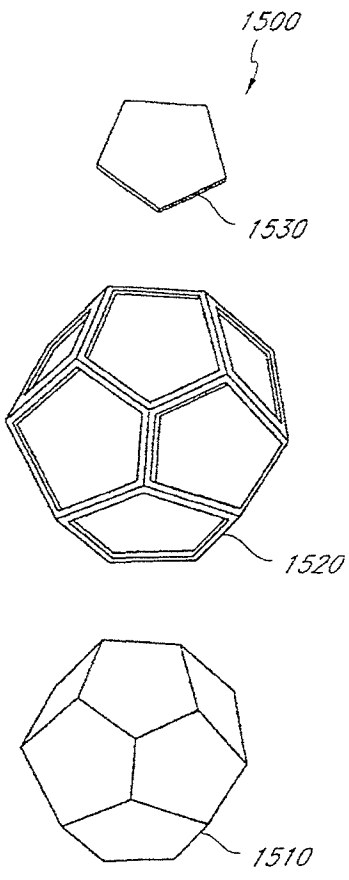
FIG. 15 illustrates an embodiment of an enclosure, protective cover, and faceplates for a dodecahedron electronic die.

FIG. 15 represents an embodiment of an electronic game piece 1500 based on a dodecahedron shape. Electronic game piece 1500 can include a game piece core 1510, protective cover 1520, and faceplates 1530 for a dodecahedron die. In an embodiment, electronic game piece 1500 is a dodecahedron die.

Figure 16:
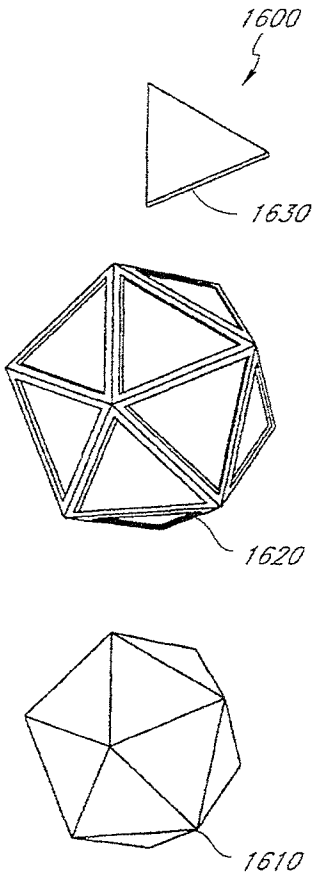
FIG. 16 illustrates an embodiment of a game piece, protective cover, and faceplates for an icosahedral die.

FIG. 16 represents an embodiment of an electronic game piece 1600 based on an icosahedron shape. Electronic game piece 1600 can include a game piece core 1610, protective cover 1620, and faceplates 930 for an icosahedron die. In an embodiment, electronic game piece 1600 is an icosohedral die.

Combination of Embodiments

Although the foregoing disclosure has been described in terms of certain preferred embodiments, other embodiments will be apparent to those of ordinary skill in the art from the disclosure herein. One of skill in the art will recognize from the present disclosure that the previously disclosed embodiments are not to be read in isolation. For example, the description of a six sided, cubical electronic die was meant as a descriptive aid. Die-casings for other embodiments could involve other shapes. Those of skill in the art will further appreciate that the various features disclosed herein can be implemented as electronic hardware, computer software, or combinations of both. To illustrate this interchangeability of hardware and software, various illustrative features have been described above generally in terms of their functionality. Whether such functionality is implemented as hardware or software depends upon the particular application and design constraints imposed on the overall system. Skilled artisans can implement the described functionality in varying ways for each particular application, but such implementation decisions should not be interpreted as causing a departure from the scope of the present disclosure.

The various features described in connection with the embodiments disclosed herein can be implemented or performed with one or more of a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be any conventional processor, controller, microcontroller, or state machine. A processor can also be implemented as a combination of computing devices, e.g., a combination of a DSP and a microprocessor, a plurality of microprocessors, one or more microprocessors in conjunction with a DSP core, multiple processors communicating with one another, or any other such configuration.

The steps of methods described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or other form of storage medium known in the art. A storage medium is coupled to the processor, such that the processor can read information from, and write information to, the storage medium. In the alternative, the storage medium can be integral to the processor. The processor and the storage medium can reside in an ASIC. The ASIC can reside in a user terminal. The processor and the storage medium can reside as discrete components in a user terminal.

The previous description of the disclosed embodiments is provided to enable a person skilled in the art to make or use the embodiments of present disclosure. Various modifications to these embodiments will be readily apparent to those skilled in the art, and the generic principles defined herein can be applied to other embodiments without departing from the spirit or scope of the invention. Thus, the present disclosure is not intended to be limited to the embodiments shown herein but is to be accorded the widest scope consistent with the principles and novel features disclosed herein.

Combinations of embodiments disclosed herein are possible, such as, for example, an embodiment might have a rechargeable battery along with an integrated processor and wireless interface that communicates with a game console using a Bluetooth protocol. Additionally, other combinations, omissions, substitutions and modifications will be apparent to the skilled artisan in view of the disclosure herein. It is contemplated that various aspects and features of the disclosure described can be practiced separately, combined together, or substituted for one another, and that a variety of combination and subcombinations of the features and aspects can be made and still fall within the scope of the disclosure. Furthermore, the systems described above need not include all of the modules and functions described in the preferred embodiments. Accordingly, the present disclosure is not intended to be limited by the recitation of the preferred embodiments.

We claim:

1. An electronic die comprising:

a die casing;

a power source configured to supply power;

an acceleration measurement system comprising a three-axis accelerometer capable of providing roll data indicative of the orientation of the die casing; and a wireless interface capable of communicating the roll data indicative of the orientation of the die casing provided by the acceleration measurement system to a monitoring device configured to provide an indication of the orientation of the die casing based on the roll data;

wherein the die casing is capable of enclosing some or all of the acceleration measurement system, the wireless interface, and the power source, and wherein when assembled at least the electronic die forms a three or more sided gaming die and each side has a marking on an outer surface to identify the side.

2. The electronic die of claim 1, wherein the die casing comprises a cube.

3. The electronic die of claim 1, wherein the markings comprise one of pips, numbers, letters, and characters.

4. The electronic die of claim 1, wherein the power source comprises one or more batteries.

5. The electronic die of claim 1, comprising a protective cover.

6. The electronic die of claim 1, comprising reversible faceplates removably affixable to an outer surface of the electronic die.

7. A method of determining roll results of an n-sided gaming die, the method comprising:

generating acceleration measurement data using an acceleration measurement system of an n-sided gaming die;

electronically receiving the acceleration measurement data by at least one of a first processor located within the electronic n-sided die and a second processor located within a monitoring device separate from the electronic n-sided die, the acceleration measurement data indicative of acceleration or vibration of the n-sided die;

electronically processing the acceleration data, by means of the first or second processor, to determine the orientation of the die, while;

electronically compensating, by means of the first or the second processor, for changes in supply voltage to provide a power compensated roll result of the electronic n-sided die, wherein the electronic compensation includes calculating a vector value indicative of the effect of gravity on the electronic n-sided die.

8. The method of claim 7, comprising electronically calibrating the acceleration measurement data.

9. The method of claim 7, wherein the calculating a vector indicative of the effect of gravity further comprises normalizing the acceleration measurement data using calibration data.

10. The method of claim 7, further comprising transmitting the roll result to the monitoring device.

11. The method of claim 7, wherein the electronic n-sided die is a twenty or fewer sided die.

12. The method of claim 7, wherein the electronic n-sided die is a six-sided die.

13. An electronic die comprising:

a die casing;

a power source configured to supply power;

an acceleration measurement system capable of providing roll data indicative of the orientation of the die casing; and a wireless interface capable of communicating a power dropout compensated roll result based on the roll data to a monitoring device configured to display the power dropout compensated roll-result;

wherein the die casing is capable of enclosing some or all of the acceleration measurement system, the wireless interface, and the power source, and wherein when assembled at least the electronic die forms a three or more sided gaming die.

14. The electronic die of claim 13, wherein the power dropout compensated roll result is based on a measurement that includes a calibrated vector value.

15. An electronic n-sided die comprising:

a die casing;

a power source configured to supply power;

an acceleration measurement system comprising a three-axis accelerometer configured to provide roll data indicative of the orientation of the die casing;

a processor configured to electronically calculate a vector indicative of the effect of gravity on the electronic n-sided die and electronically determine a roll result of the electronic n-sided die based on the vector; and a wireless interface configured to communicate the roll result indicative of the orientation of the die casing to a monitoring device configured to provide an indication of the roll result;

wherein the die casing encloses some or all of the acceleration measurement system, the wireless interface, the processor and the power source and wherein each of the n sides of the electronic die has a marking on an outer surface to identify the side.

16. The electronic die of claim 15, wherein the die casing comprises a cube.

17. The electronic die of claim 15, wherein the processor is a microprocessor, a microcontroller, a field programmable gate array, a digital signal processor, a programmable logic device, an application specific integrated circuit, or a series discrete digital logic.

18. The electronic die of claim 15, wherein the monitoring device is configured to display the roll result.

19. An electronic n-sided die comprising:

a cubic die casing;

a power source configured to supply power;

an acceleration measurement system, including a three-axis accelerometer, configured to provide roll data indicative of the orientation of the die casing;

a microcontroller with integrated analog to digital converters configured to electronically calculate a vector indicative of the effect of gravity on the electronic n-sided die and electronically determine a roll result of an electronic n-sided die based on the vector; and a wireless interface configured to communicate the roll result to a monitoring device configured to provide an indication of the roll result, wherein the die casing encloses some or all of the acceleration measurement system, the wireless interface, the microcontroller and the power source and wherein each of the n sides has a marking on an outer surface to identify the side.

20. The electronic die of claim 19, wherein the power source comprises one or more batteries.

21. The electronic die of claim 19, wherein the monitoring device is configured to display the roll result.

22. An electronic die system comprising:

a monitoring device and an electronic die, the electronic die comprising:

a die casing;

a power source configured to supply power, an acceleration measurement system comprising a three-axis accelerometer configured to provide roll data indicative of the orientation of the die casing; and a wireless interface configured to communicate the roll data indicative of the orientation of the die casing provided by the acceleration measurement system, wherein the monitoring device is configured to provide an indication of a roll result indicative of the orientation of the die casing based on the roll data;

wherein the die casing encloses some or all of the acceleration measurement system, the wireless interface, and the power source and wherein when assembled at least the electronic die forms a three or more sided gaming die and each side has a marking on an outer surface to identify the side.

23. The electronic die system of claim 22, wherein the die casing comprises a cube.

24. The electronic die system of claim 22, wherein the die further comprises markings on outer surfaces thereof.

25. The electronic die system of claim 24, wherein the markings comprise one of pips, numbers, letters, and characters.

26. The electronic die system of claim 22, wherein the power source comprises one or more batteries.

27. The electronic die system of claim 22, comprising a protective cover.

28. The electronic die system of claim 22, comprising reversible faceplates removably affixable to an outer surface of the electronic die.

29. The electronic die system of claim 22, wherein the monitoring device is a cell phone or a mobile device.

30. The electronic die system of claim 22, wherein the monitoring device comprises a video display, an alphanumeric display, or a series of light emitting diodes for indicating the roll result.

31. The electronic die system of claim 22, wherein the monitoring device is configured to indicate the roll result by audio tone or speech.

32. The electronic die system of claim 22, wherein the signal indicative of the orientation of the die casing or signals responsive to said signal are a roll result indicative of the orientation of the die casing based on the roll data.

33. An electronic die system comprising:

a monitoring device and an electronic die, the electronic die comprising:

a die casing;

a power source configured to supply power, an acceleration measurement system configured to provide roll data indicative of the orientation of the die casing or a roll result based on the roll data; and a wireless interface configured to communicate the roll data indicative of the orientation of the die casing provided by the acceleration measurement system, wherein the monitoring device is configured to display the roll result and wherein the displayed roll result is a power dropout compensated roll result based on the roll data.

34. The electronic die system of claim 22, wherein the monitoring device is further configured to provide an indication of a roll as it occurs before the die casing comes to rest.

35. The electronic die system of claim 33, wherein the power dropout compensated roll result is based on a measurement that includes a calibrated vector value.

* * * * *